US009252505B2

(12) United States Patent
Otsuka et al.

(10) Patent No.: US 9,252,505 B2
(45) Date of Patent: Feb. 2, 2016

(54) TERMINAL CONNECTOR, ELECTRIC WIRE WITH TERMINAL CONNECTOR, AND METHOD OF CONNECTING TERMINAL CONNECTOR AND ELECTRIC WIRE

(75) Inventors: Takuji Otsuka, Yokkaichi (JP); Hiroki Hirai, Yokkaichi (JP); Junichi Ono, Yokkaichi (JP); Kingo Furukawa, Yokkaichi (JP); Teruyoshi Munekata, Yokkaichi (JP); Hajime Ota, Osaka (JP); Yoshihiro Nakai, Osaka (JP); Taichiro Nishikawa, Osaka (JP); Tetsuya Kuwabara, Osaka (JP); Yoshiyuki Takaki, Osaka (JP); Hiroyuki Kobayashi, Osaka (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 19 days.

(21) Appl. No.: 14/241,744

(22) PCT Filed: Aug. 30, 2012

(86) PCT No.: PCT/JP2012/071993

§ 371 (c)(1),
(2), (4) Date: Feb. 27, 2014

(87) PCT Pub. No.: WO2013/031885

PCT Pub. Date: Mar. 7, 2013

(65) Prior Publication Data

US 2014/0224535 A1 Aug. 14, 2014

(30) Foreign Application Priority Data

Sep. 1, 2011 (JP) ..... 2011-190426

(51) Int. Cl.
*H01R 4/20* (2006.01)
*H01R 4/18* (2006.01)

(Continued)

(52) U.S. Cl.
CPC .. *H01R 4/18* (2013.01); *H01B 1/02* (2013.01); *H01R 4/185* (2013.01); *H01R 4/62* (2013.01);

(Continued)

(58) Field of Classification Search
CPC ..... H01R 4/18; H01R 4/20
USPC ..... 174/84 C, 94 R
See application file for complete search history.

(56) References Cited

U.S. PATENT DOCUMENTS 2,480,280 A * 8/1949 Bergan ..... 439/882
3,100,933 A * 8/1963 Hancock et al. ..... 228/116

(Continued)

FOREIGN PATENT DOCUMENTS

CN 101997176 3/2011
EP 0 018 863 11/1980

(Continued)

OTHER PUBLICATIONS

Japanese Patent Appl. No. 2011-190426—Office Action issued Jan. 20, 2015.

(Continued)

*Primary Examiner* — Chau N Nguyen
(74) *Attorney, Agent, or Firm* — Gerald E. Hespos; Michael J. Porco; Matthew T. Hespos

(57) ABSTRACT

An object is to obtain a stable electric connection resistance under a mild crimping condition. The present invention is a terminal connector 12 that includes a crimp portion 30 to be crimped to an electric wire. The crimp portion 30 includes a base material, an aluminum layer or an aluminum alloy layer a surface on the base material, and a hard layer on a surface of the aluminum layer or the aluminum alloy layer. The hard layer is harder than the base material. The present invention may be an electric wire with a terminal connector 10 that includes the above terminal connector 12 and a covered electric wire 40 that includes a core wire 42 made of aluminum or aluminum alloy. The crimp portion 30 of the terminal connector 12 is crimped to the core wire 42.

11 Claims, 21 Drawing Sheets

(51) Int. Cl.

| | |
|---|---|
| ***H01R 4/62*** | (2006.01) |
| ***H01B 1/02*** | (2006.01) |
| ***H01R 43/048*** | (2006.01) |
| ***H01R 13/03*** | (2006.01) |

(52) U.S. Cl.
CPC ..... *H01R 13/03* (2013.01); *H01R 43/048* (2013.01); *H01R 43/0482* (2013.01); *Y10T 29/49185* (2015.01)

(56) References Cited

U.S. PATENT DOCUMENTS

| | | | | |
|---|---|---|---|---|
| 3,157,735 | A * | 11/1964 | Stroup et al. | 174/94 R |
| 3,895,851 | A * | 7/1975 | Bolton et al. | 439/387 |
| 8,303,355 | B2 | 11/2012 | Ono et al. | |
| 8,628,363 | B2 | 1/2014 | Kobayashi et al. | |
| 2012/0234597 | A1 * | 9/2012 | Madden | 174/74 R |

FOREIGN PATENT DOCUMENTS

| | | |
|---|---|---|
| JP | 55-150569 | 11/1980 |
| JP | 2003-243057 | 8/2003 |
| JP | 2003-243058 | 8/2003 |
| JP | 2004-006070 | 1/2004 |
| JP | 2010-3584 | 1/2010 |

OTHER PUBLICATIONS

International Search Report of Oct. 31, 2012.

International Preliminary Report on Patentability.

Written Opinion of the International Searching Authority.

Japanese Patent Appl. No. 2011-190426—Office Action issued Nov. 18, 2014.

Chinese Patent Appl. No. 2012-80042036.5—Office Action issued Aug. 31, 2015.

* cited by examiner

TERMINAL CONNECTOR, ELECTRIC WIRE WITH TERMINAL CONNECTOR, AND METHOD OF CONNECTING TERMINAL CONNECTOR AND ELECTRIC WIRE

BACKGROUND

1. Field of the Invention

The present invention relates to a terminal connector, an electric wire with a terminal connector, and a method of connecting a terminal connector and an electric wire.

2. Description of the Related Art

Conventionally, Japanese Unexamined Patent Publication No. 2010-3584 discloses a known method of connecting a terminal connector and an aluminum electric wire that includes an aluminum core covered by an insulating covering. An oxide film is likely to be formed on a surface of a core of the aluminum electric wire. A crimping section of the terminal connector is serrated to break the oxide film, and the oxide film formed on the surface of the aluminum electric wire is broken by the serration. In this configuration, the core is electrically conductively connected to the crimping section when the oxide film is broken to uncover the aluminum core. As a result, electrical connection resistance between the aluminum electric wire and the terminal connector can be reduced.

However, in the above-described connection method, although the oxide film is broken by the serration, the crimping section is still required to be crimped hard to obtain stable electrical connection resistance. When the crimping section is crimped hard, the terminal connector may be damaged or the crimped section may protrude from a rear end of a connector because the crimping section is extended in a front-rear direction. A connection method that can provide stable electrical connection resistance even under mild crimping condition has been expected.

The present invention has been achieved in view of the above. It is an object of the present invention to obtain stable electrical connection resistance even under the mild crimping condition.

SUMMARY OF THE INVENTION

The present invention is a terminal connector that includes a crimp portion to be crimped to an electric wire. The crimp portion includes a base material, an aluminum layer or an aluminum alloy layer on the base material, and a hard layer on the aluminum layer or the aluminum alloy layer. The hard layer is harder than the base material.

The present invention may be an electric wire with a terminal connector that includes the above-described terminal connector and an electric wire including a core wire made of aluminum or aluminum alloy. The crimp portion of the terminal connector is crimped to the core wire.

The present invention may be a method of connecting a terminal connector and an electric wire. The terminal connector includes a crimp portion connected to the electric wire including a core wire made of aluminum or aluminum alloy. The method includes forming a hard layer on an aluminum layer or an aluminum alloy layer formed on a base material included in the crimp portion and deforming and crimping the crimp portion to the core wire such that the hard layer is broken. The broken hard layer cuts a surface layer of the core wire such that a core of the core wire is uncovered, and the uncovered core and the base material are in pressure contact with each other. The hard layer is harder than the base material.

In this configuration, the hard layer is not deformed along with the deformation of the crimp portion when the crimp portion of the terminal connector is crimped onto the core wire of the electric wire, because the hard layer is harder than the base material. Accordingly, the hard layer can be easily broken. The broken hard layer cuts the oxide film formed on the surface of the core wire of the electric wire such that the core of the core wire is uncovered, and thus the uncovered core and the base material that is uncovered when the hard layer is broken can be electrically connected. With this configuration, the terminal connector is hardly damaged by tight crimping of the terminal connector and the crimp portion hardly protrudes from the rear end of the connector. Therefore, the stable electrical connection resistance under the mild crimping condition can be obtained.

The following configurations are preferable as embodiments of the present invention.

The base material may be a metal material that is same as a metal material constituting the aluminum layer or the aluminum alloy layer. The base material and the aluminum layer or the aluminum alloy layer may be an integral member.

With this configuration, the base material and the aluminum layer or the aluminum alloy layer can be integrally formed.

The hard layer may be an alumite layer.

The alumite is an oxide film formed on a surface of the aluminum or the aluminum alloy, and thus the alumite layer as the hard layer is easily formed on the surface of the aluminum layer or the aluminum alloy layer.

The alumite layer may have a thickness of 1 μm or more and 10 μm or less.

With this configuration, the core of the core wire and the base material of the terminal connector can be properly connected and a connection structure with low resistance can be obtained because excessive insulators (broken pieces of the alumite layer) are not provided between the core and the base material.

The base material may be an aluminum alloy selected from 2000 series alloy, 6000 series alloy, and 7000 series alloy.

The above aluminum alloys have high mechanical characteristics such as bending property, and thus the aluminum alloys can be properly worked, for example, pressed. In addition, the above aluminum alloys have high thermal resistance, and thus the aluminum alloys can be used in high temperature environment (for example, at a temperature of about 120° C. to about 150° C. when applied to automobiles).

EFFECT OF THE INVENTION

According to the present invention, the stable connection resistance under the mild crimping conditions can be obtained.

DETAILED DESCRIPTION OF THE PREFERRED EMBODIMENTS

Figure 1:
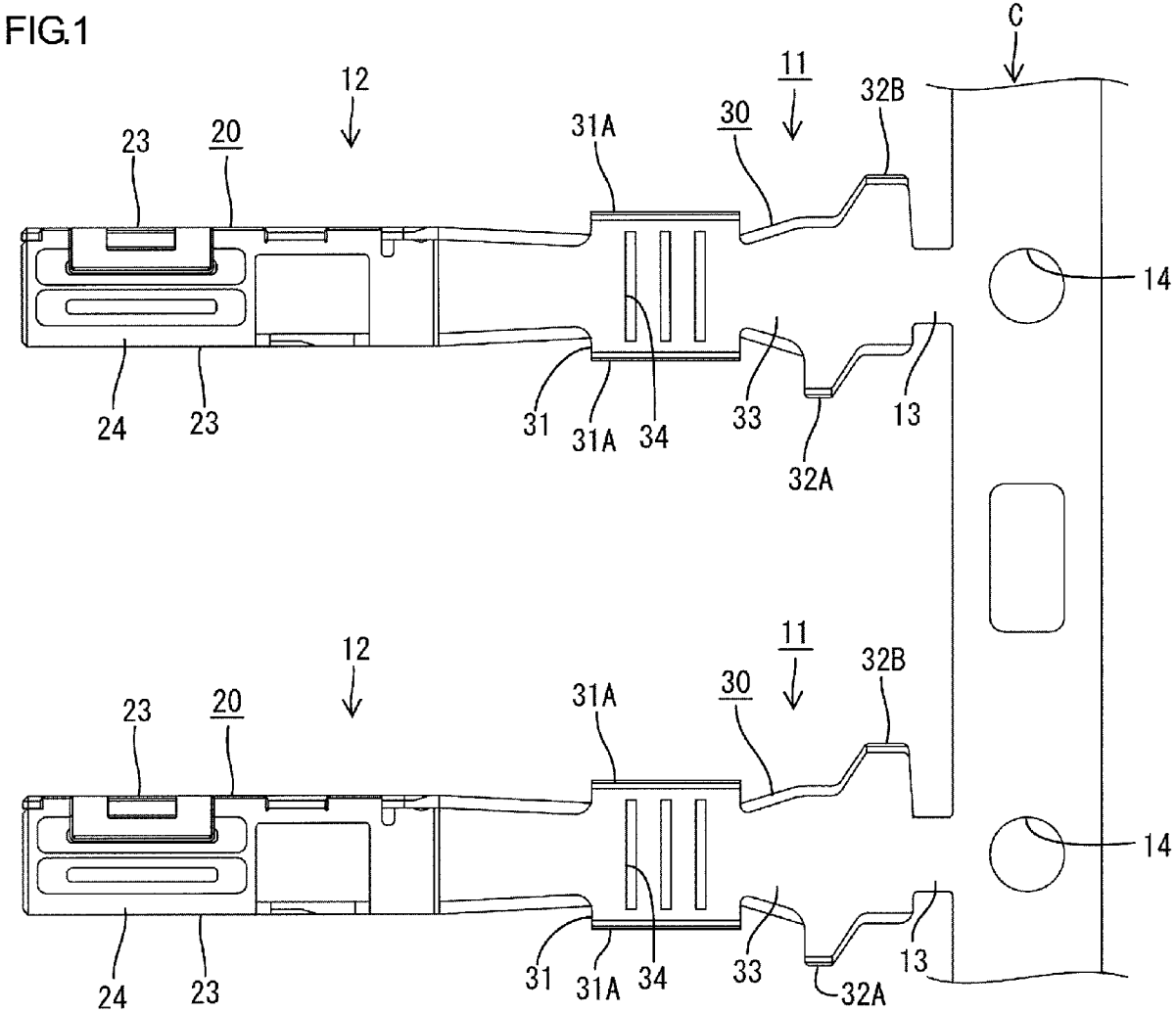
FIG. 1 a plan view of a terminal connector according to an embodiment.
Figure 2:
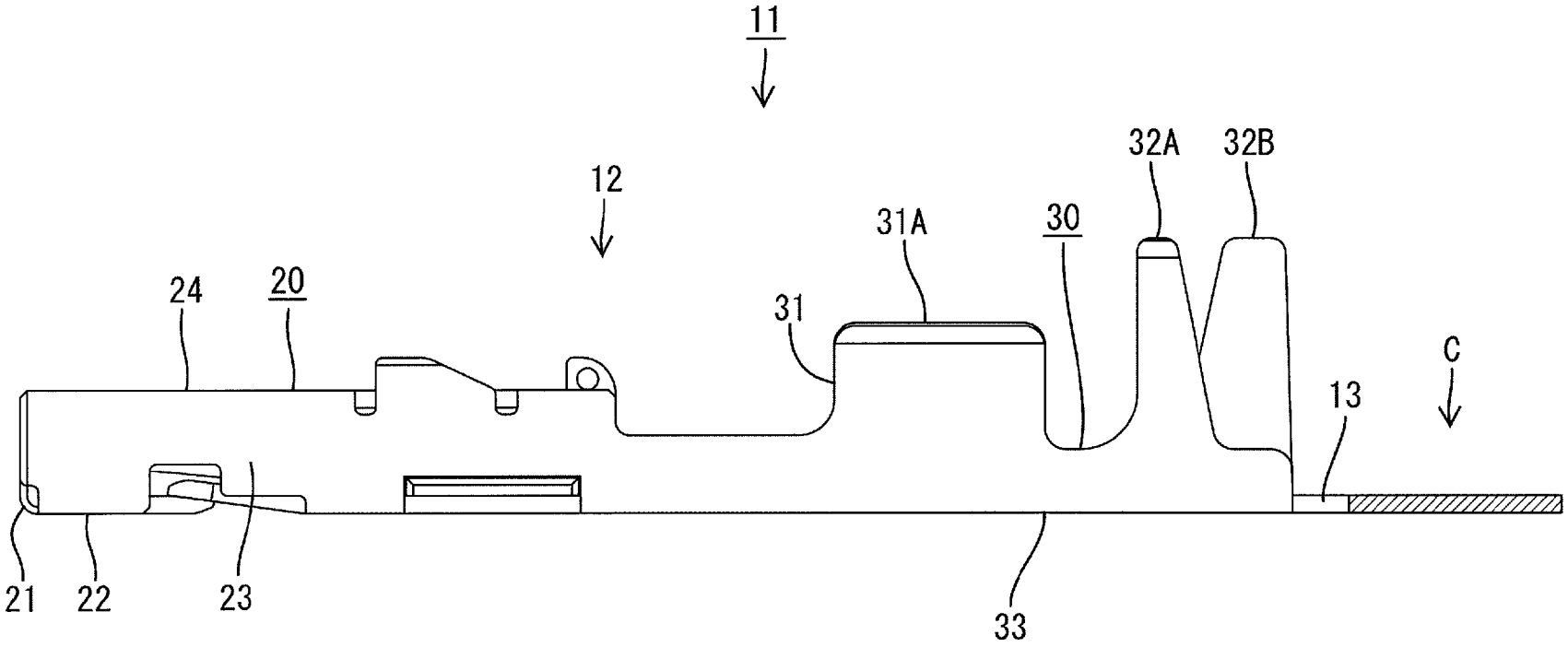
FIG. 2 is a side view of the terminal connector.

An embodiment of the present invention will be described with reference to FIG. 1 to FIG. 18. As illustrated in FIG. 1, before crimping, a terminal connector 12 includes a body 20 having a polygonal tubular shape and a crimp portion 30 formed on a rear of the body 20. The terminal connector 12 is an aluminum terminal that is formed by pressing an aluminum alloy plate, which is a base material, (by punching out the aluminum alloy plate in a predetermined shape and further bending it). More specifically described, the base material is an aluminum alloy plate of 6000 series alloy (6061 alloy, for example) of JIS (JIS H 4000:1999). For example, the base material is produced through casting, hot rolling, cold rolling, and various thermal treatments (for example, T6 treatment). In this embodiment, the terminal connector 12 is a female terminal connector, but may be a male terminal connector having a tab-like shape according to the present invention. The base material of the terminal connector 12 may be made of any metal such as copper, copper alloy, and aluminum.

The aluminum alloy may have a composition high in mechanical properties such as bending and high in heat resistance. Specific examples include 2000 series alloy, 6000 series alloy, and 7000 series alloy of JIS (JIS H 4000:1999). The 2000 series alloy is an aluminum-copper alloy, which is referred to as a duralumin or a super duralumin, and is high in strength. Specific examples of the alloy number include 2024 and 2219. The 6000 series alloy is an aluminum-magnesium-silicon alloy and is high in strength, corrosion resistance, and anodizing properties. Specific examples of the alloy number include 6061. The 7000 series alloy is an aluminum-zinc-magnesium alloy, which is referred to as an extra super duralumin and extremely high in strength. Examples of specific alloy number include 7075.

A covered electric wire 40 is an aluminum electric wire and includes a core wire 42 including a plurality of metal wires 41 and a covering 43 made of an insulating synthetic resin. The covering 43 covers the core wire 42. The covered electric wire 40 of this embodiment includes a bundle of eleven metal wires 41. As a core of the metal wire 41 included in the core wire 42, any metal such as copper, copper alloy, aluminum, and aluminum alloy may be used. The metal wire 41 of this embodiment is made of aluminum alloy. In this embodiment, the terminal connector 12 that is made of the aluminum alloy and the core wire 42 that is made of the aluminum alloy are connected, i.e., the members that include the same kind of metal as a major component are connected, and thus electric corrosion hardly occurs.

The aluminum alloy included in the covered electric wire includes at least one element selected from iron, magnesium, silicon, copper, zinc, nickel, manganese, silver, chrome, and zirconium in a total amount of 0.005% by mass or more and 5.0% by mass or less, and the balance is aluminum and impurities. The aluminum alloy preferably contain the elements (% by mass) in an amount as follows: iron: 0.005% or more and 2.2% or less; magnesium: 0.05% or more and 1.0% or less, manganese, nickel, zirconium, zinc, chrome, and silver: 0.005% or more and 0.2% or less in total; copper: 0.05% or more and 0.5% or less, silicon: 0.04% or more and 1.0% or less. One or more of the additive elements may be contained in combination. In addition to the above-described additive elements, the alloy may contain 500 ppm or less of titanium, boron. Examples of the alloy containing the above-described additive elements include aluminum-iron alloy, aluminum-iron-magnesium alloy, aluminum-iron-magnesium-silicon alloy, aluminum-iron-silicon alloy, aluminum-iron-magnesium-(manganese, nickel, zirconium, silver) alloy, aluminum-iron-copper alloy, aluminum-iron-copper-(magnesium, silicon) alloy, and aluminum-magnesium-silicon-copper alloy.

The aluminum alloy constituting the covered electric wire may be a single wire, a strand of metal wires, ora compressed stranded wire. A diameter of the core wire (a diameter of each core wire of the strand before stranding) may be properly selected based on usage. For example, the core wire may have a diameter of 0.2 mm or more and 1.5 mm or less.

The aluminum alloy constituting the covered electric wire (the metal wire of the bundle) satisfies at least one of a tensile strength of 110 MPa or more and 200 MPa or less, a 0.2% proof stress of 40 MPa or more, an elongation of 10% or more, and an electrical conductivity of 58% or more IACS (International Annealed Copper Standard). Particularly, the core that satisfies the elongation of 10% or more has high impact resistance and is less likely to be broken when the terminal connector is attached to another terminal connector, a connector, or an electric device.

The insulating covering included in the covered electric wire may be various insulating materials such as polyvinyl chloride (PVC), halogen free resin composition including polyolefin resin as a base, and a flame retardant composition. The covering may have a thickness that is properly selected in view of a desired insulating strength.

The core wire may be produced through a process such as casting, a hot rolling (homogenization for billet casting material), and a cold drawing process (which may properly include processes such as a softening treatment, stranding, and compression). The covered electric wire can be produced by forming an insulating layer on an outer circumferential surface of the core wire.

As illustrated in FIG. 1, a plurality of terminal connectors 12 are connected to one edge of a carrier C. The terminal connectors 12 each protrude frontward from a front edge of the carrier C. The terminal connectors 12 are arranged with a predetermined space therebetween in a carrying direction of the carrier C. The terminal connectors 12 and the carrier C are connected by a connection portion 13. The terminal connectors 12, the carrier C, and the connection portions 13 constitute a terminal connector with a carrier 11.

The body 20 includes a bottom 22, two sides 23 that rise from respective side edges of the bottom 22, and a top 24 that is a portion bended at an upper edge of one of the sides 23 toward an upper edge of the other side 23.

An flexible contact strip 21 that is elastically displaceable is formed inside the body 20. The flexible contact strip 21 is a portion bended rearward from a front edge of the bottom 22. In the body 20, the flexible contact strip 21 and an opposed surface facing the flexible contact strip 21 (a lower surface of the top 24) provide a space therebetween to which a conductive body having a tab-like shape (not illustrated) can be inserted. A distance between the flexible contact strip 21 and the opposed surface in a natural state is smaller than a thickness of the conductive body to be inserted. In this configuration, when the conductive body is inserted between the flexible contact strip 21 and the opposed surface with the flexible contact strip 21 being bent by the conductive body, the conductive body is elastically in contact with and electrically connected to the flexible contact strip 21.

The crimp portion 30 includes a U-like shaped wire barrel 31 and a U-like shaped insulation barrel 32 that is arranged on a rear of the wire barrel 31. The crimp portion 30 includes a bottom wall 33 that continuously extends from the bottom 22 of the body 20 in the front-rear direction.

The wire barrel 21 includes two swaging pieces 31A, 31A that extends upwardly from respective side edges of the bottom wall 33 with facing each other. An end portion of the core wire 42 is arranged along the front-rear direction on the bottom wall 33, and the wire barrel 31 is configured to crimp the core wire 42 by swaging the end portion of the core wire 42 by the swaging pieces 31A, 31A. The core wire 42 is in conductively contact with the swaging pieces 31A, 31A and the bottom wall 33, and thus the core wire 42 and the wire barrel 31 are electrically connected.

The insulation barrel 32 includes two swaging pieces 32A, 32B that extend upwardly from respective side edges of the bottom wall 33. The swaging pieces 32A, 32B are arranged away from each other in the front-rear direction. In the following description, one located at a front side is referred to as the swaging piece 32A and the other one located at a rear side is referred to as the swaging piece 32B. The covering 43 is arranged on the bottom wall 33, and the insulation barrel 32 is configured to crimp the core wire 42 and the covering 43 by swaging the covering 43 by the swaging pieces 32A, 32B.

As illustrated in FIG. 1, the carrier C has carriage holes 14 for carrying the carrier C at positions corresponding to the connection portions 13. The carriage holes 14 each are a circular hole and extend through the carrier C in the thickness direction thereof. A crimping apparatus 50 (see FIG. 3 and FIG. 4) includes a carriage shaft (not illustrated) that is configured to be inserted into the carriage hole 14 to carry the terminal connector with the carrier 11.

Figure 3:
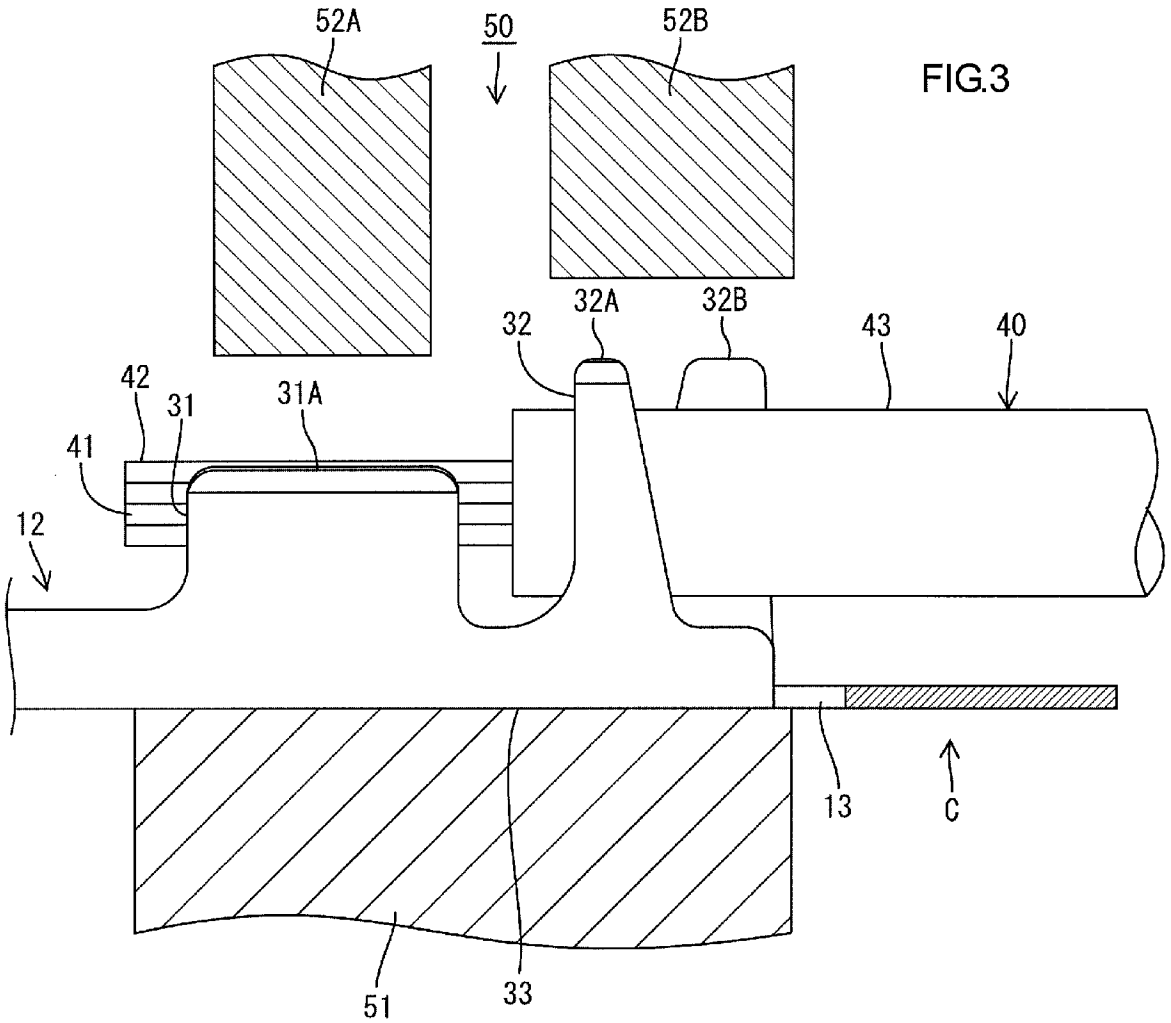
FIG. 3 is a side view illustrating a state immediately before a crimp portion of the terminal connector is crimped by a crimper.
Figure 4:
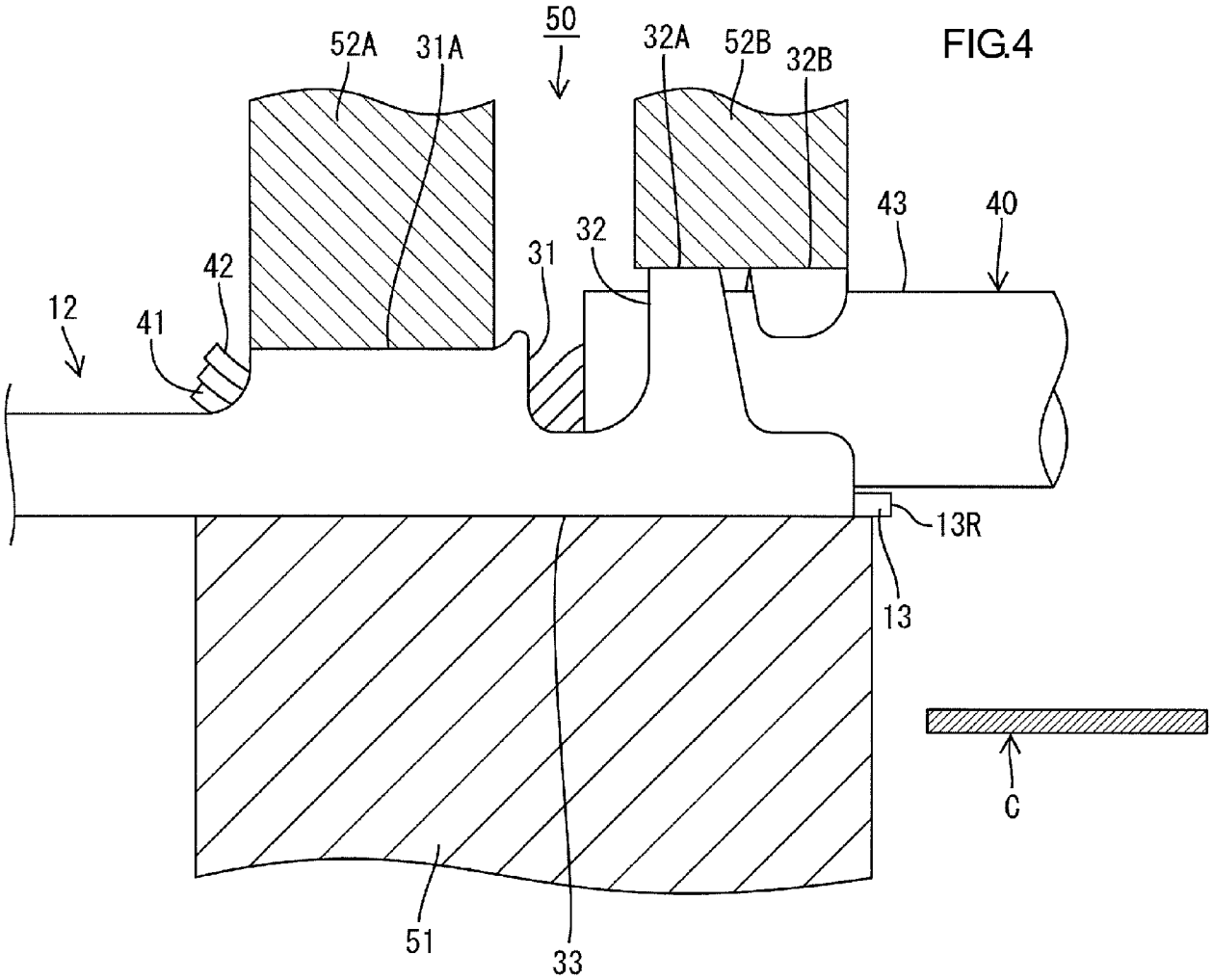
FIG. 4 is a side view illustrating a state immediately after the crimp portion of the terminal connector is crimped by the crimper.
Figure 5:
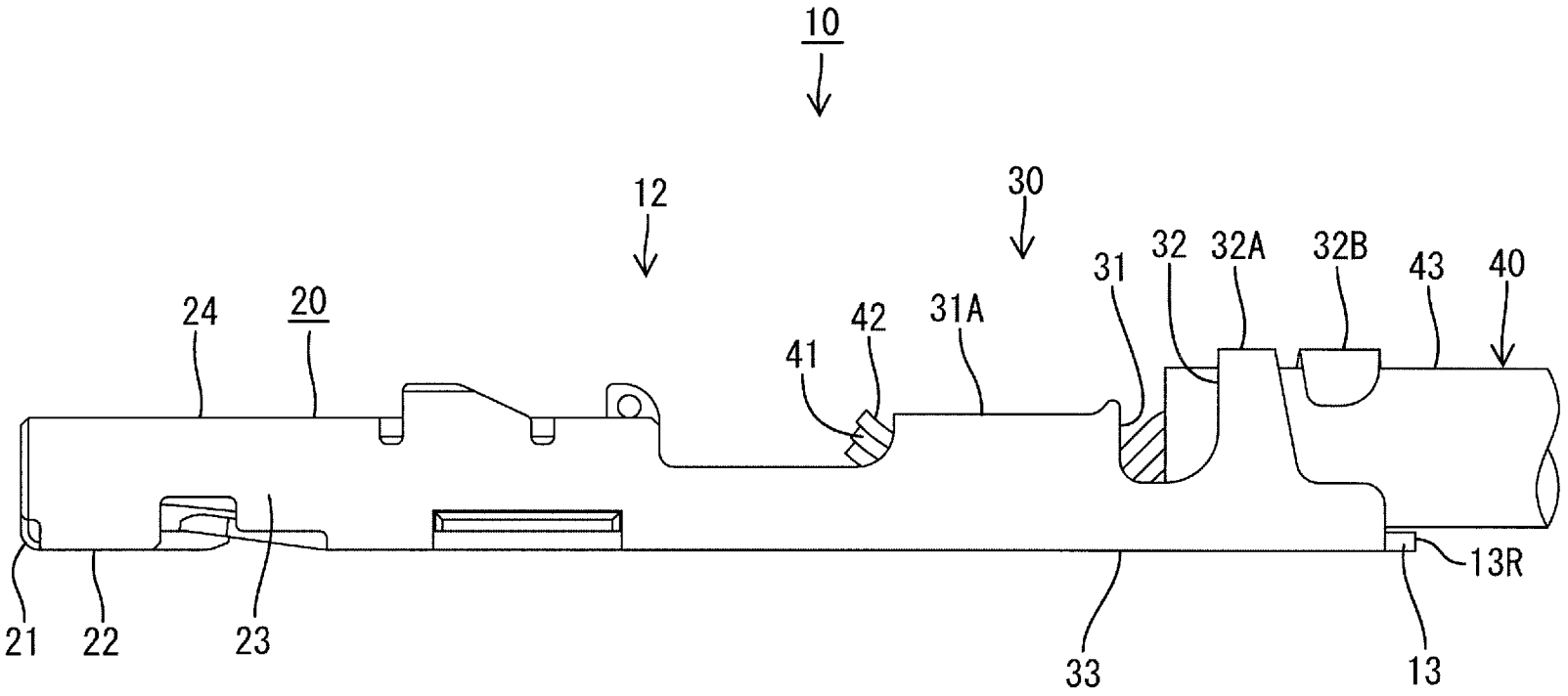
FIG. 5 is a side view of an electric wire with the terminal connector.

As illustrated in FIG. 3, the crimping apparatus 50 includes an anvil 51 and two crimpers 52A, 52B that are arranged above the anvil 51. The wire barrel 31 and the insulation barrel 32 are placed on the anvil 51. The crimper 52A that corresponds to the wire barrel 31 is referred to as a first crimper 52A and the crimper 52B that corresponds to the insulation barrel 32 is referred to as a second crimper 52B. The crimpers 52A, 52B are configured to be moved in a vertical direction by a driving means that is not illustrated.

On a rear side of the terminal connector 12, a cutting machine (not illustrated) that is configured to cut the terminal connector 12 from the carrier C is arranged. The terminal connector with the carrier 11 is carried into the crimping apparatus 50 by the carrier C, and then the end portion of the covered electric wire 40 is arranged on the crimp portion 30. Subsequently, the crimp portion 30 is crimped by the crimping apparatus 50 and the crimp portion 30 is separated from the carrier C by the cutting machine. As a result, the electric wire with the terminal connector 10 is formed.

On a surface of each metal wire 41 included in the core wire 42, an insulating oxide film (for example, oxidized aluminum) L is likely to be formed due to a reaction with moisture or oxygen in the air. If the core wire 42 is connected to the wire barrel 31 with the oxide film L formed therebetween, the electrical connection resistance becomes larger.

To solve this problem, in this embodiment, serrations 34 are provided on a crimping surface that is to be in contact with the core wire 42. The core wire 42 is buried into the serration 34 such that the edges of the serrations 34 break the oxide film L. Three serrations 34 are each formed in a groove-like shape that extends in a width direction, which is a direction perpendicular to the front-rear direction of the wire barrel 31, and arranged with a predetermined space therebetween in the front-rear direction.

To obtain the stable electrical connection resistance even after an endurance testing such as a thermal shock testing is performed, a compression ratio of the wire barrel 31 (a ratio calculated by dividing a cross-sectional area of a conductor after crimping by a cross-sectional area of the conductor before crimping) is required to be low. Here, "low compression ratio" means that the wire barrel 31 is compressed under higher compression condition, and hereinafter may be simply referred to as "tight compression". Similarly, "high compression ratio" means that the wire barrel 31 is compressed under lower (more mild) compression condition, and hereinafter may be simply referred to as "loose compression". When the wire barrel 31 is tightly compressed, the wire barrel 31 is plastically deformed, and the wire barrel 31 is elongated in the front-rear direction. Particularly, a rear end 13R of the connection portion 13 that protrudes from a rear end of the swage piece 32B on the rear side protrudes from a cavity when the electric wire with the terminal connector 10 is inserted into a cavity (not illustrated) of a connector (not illustrated), and thus a leak is likely to occur between the electric wires with the terminal connectors 10 that are adjacent to each other.

Figure 6:
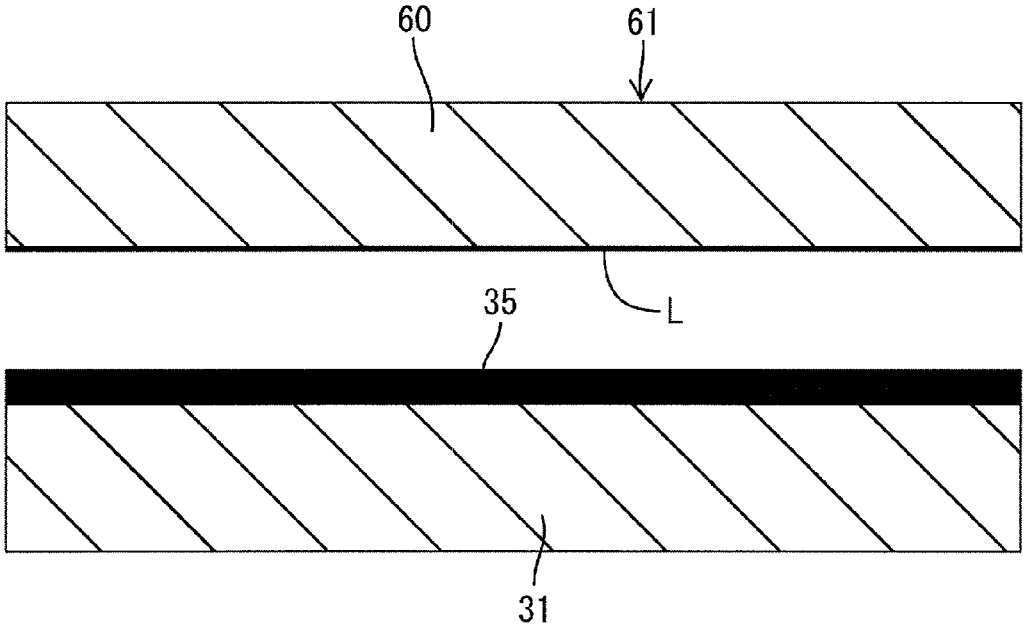
FIG. 6 is a cross-sectional view illustrating a state before an aluminum terminal and an aluminum electric wire are crimped.

To solve the problem, in this embodiment, as illustrated in FIG. 6, an alumite layer 35, which is an anodized layer, is formed on a crimping surface (a conductive body contact surface to be in contact with the core wire 42) of the wire barrel 31. The alumite layer 35 remains between the core wire 42 and the wire barrel 31 after the terminal connector 12 is attached to the end portion of the covered electric wire 40. An oxidized aluminum ($Al_2O_3$) that is a main component of the alumite layer 35 is an insulator, and thus if the alumite layer 35 is too thick, the electrical connection resistance may become larger. In addition, if the alumite layer 35 is too thin, the oxide film L formed on the surface of the core wire 42 is not sufficiently broken, and thus the electrical connection resistance may become larger. Thus, preferably, the alumite layer 35 has a thickness of 0.5 μm or more and 10 μm or less. The alumite layer 35 is a porous layer and has a denser crystal structure than the oxide film L. The alumite layer 35 has a hardness of 200 to 250 Hv. The aluminum alloy, which is the base material, has a hardness of 30 to 105 Hv. The alumite layer 35 is a hard layer that is harder than the base material. In this configuration, when the wire barrel 31 is swaged, the alumite layer 35 is broken into alumite pieces because the alumite layer 35 cannot be deformed along the deformation of the wire barrel 31. The alumite pieces protrude from a surface of the wire barrel 31.

The alumite layer 35 is formed by an electrolytic treatment (specifically, a degreasing process, an etching process, a water cleaning process, an acid cleaning process, a water cleaning process, an anodizing process, and a water cleaning process are sequentially performed). In the degreasing process, impregnation with commercially available degreasing solution, impregnation with an ethanol solution with stirring, and an ultrasonic cleaning are performed in this sequence. In the etching process, an aqueous sodium hydroxide solution (200 g/L, pH=12) is used. In the acid cleaning process, an aqueous mixed acid solution of nitric acid: 400 ml/L and hydrofluoric acid: 40 ml/L is used. In the anodizing process, a dilute sulfuric acid solution (an aqueous sulfuric acid solution (200 ml/L)) is used, and energizing current and energizing time are controlled to obtain the alumite layer 35 having a desired thickness. In the water cleaning process after the etching process, the ultrasonic cleaning is used. In the water cleaning process after the acid cleaning process and the water cleaning process after the anodizing process, running water is used.

Figure 7:
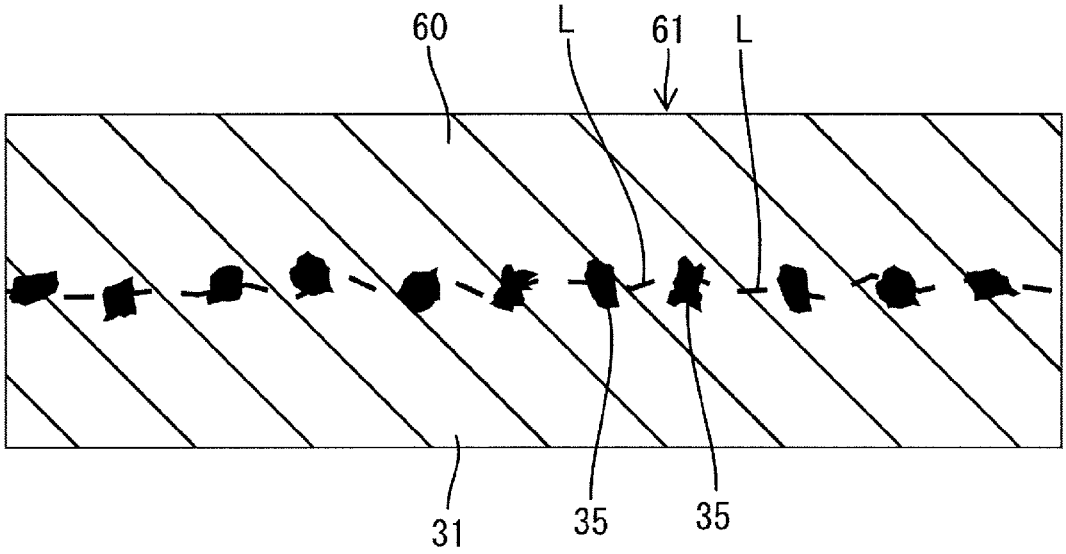
FIG. 7 is a cross-sectional view illustrating a state after the aluminum terminal and the aluminum electric wire are crimped.

In FIG. 6, for brief explanation of how the alumite layer 35 breaks the oxide film L during the compression, a metal wire 61 that includes a core 60 made of aluminum alloy and having the oxide film L on its surface is illustrated. Initially, the swaging pieces 31A, 31A in a state of FIG. 6 are swaged such that the wire barrel 31 is deformed. Then, the alumite layer 35 is broken, because the alumite layer 35 cannot be deformed along with the deformation of the core 60. As illustrated in FIG. 7, the broken alumite layer 35 breaks the oxide film L by scratching and peeling. In this state, the aluminum alloy that is the base material of the wire barrel 31 and the aluminum alloy that is the core 60 of the metal wire 61 are in pressure contact with each other and integrated, and thus they are electrically conductively connected. With this configuration, the stable electrical connection resistance can be obtained by the wire barrel 31 that is loosely compressed, not tightly compressed.

However, the oxide film L that can be broken by the serration 34 is clearly limited to the oxide film L of the metal wire 41 that is positioned on the outer circumference of the core wire 42. An oxide film L of the metal wire 41 that is positioned on an inner side, not on the outer circumference, of the core wire 42 cannot be in direct contact with the serration 34, and thus the stable electrical connection resistance cannot be obtained.

To solve this problem, in this embodiment, all of the metal wires 41 of the core wire 42 has an alumite layer 44 on their surfaces. Like the alumite layer 35 of the wire barrel 31, the alumite layer 44 is formed by the electrolytic treatment to the surface of the aluminum alloy, which is the core. The alumite layer 44 has the same properties as the alumite layer 35.

Figure 9:
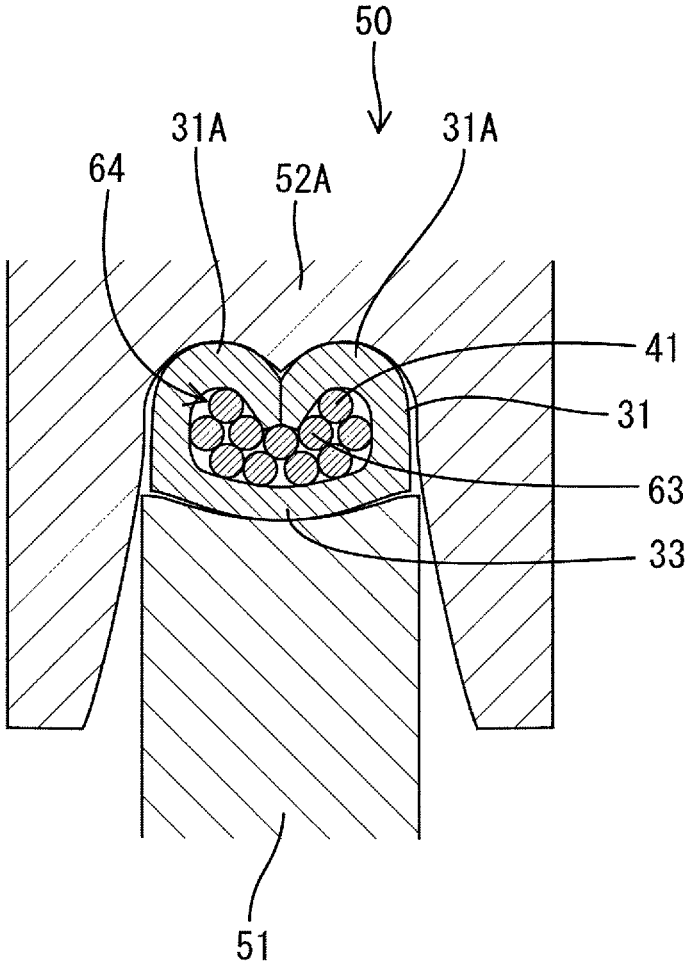
FIG. 9 is a front cross-sectional view illustrating a state during the aluminum terminal is crimped by the crimper.
Figure 10:
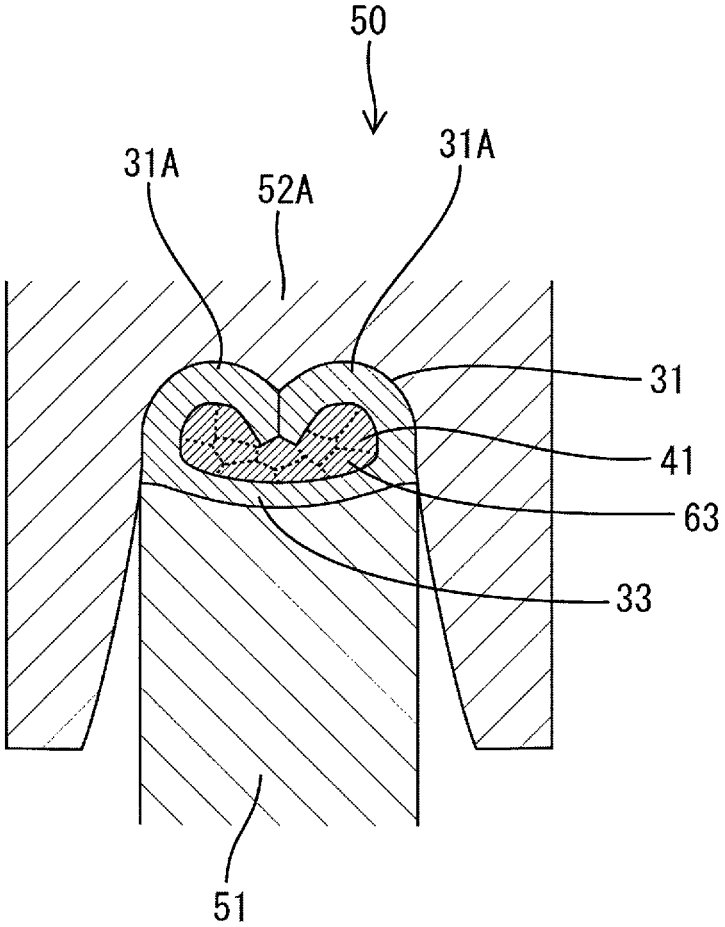
FIG. 10 is a front cross-sectional view illustrating a state immediately after the crimp portion of the aluminum terminal is crimped by the crimper.
Figure 11:
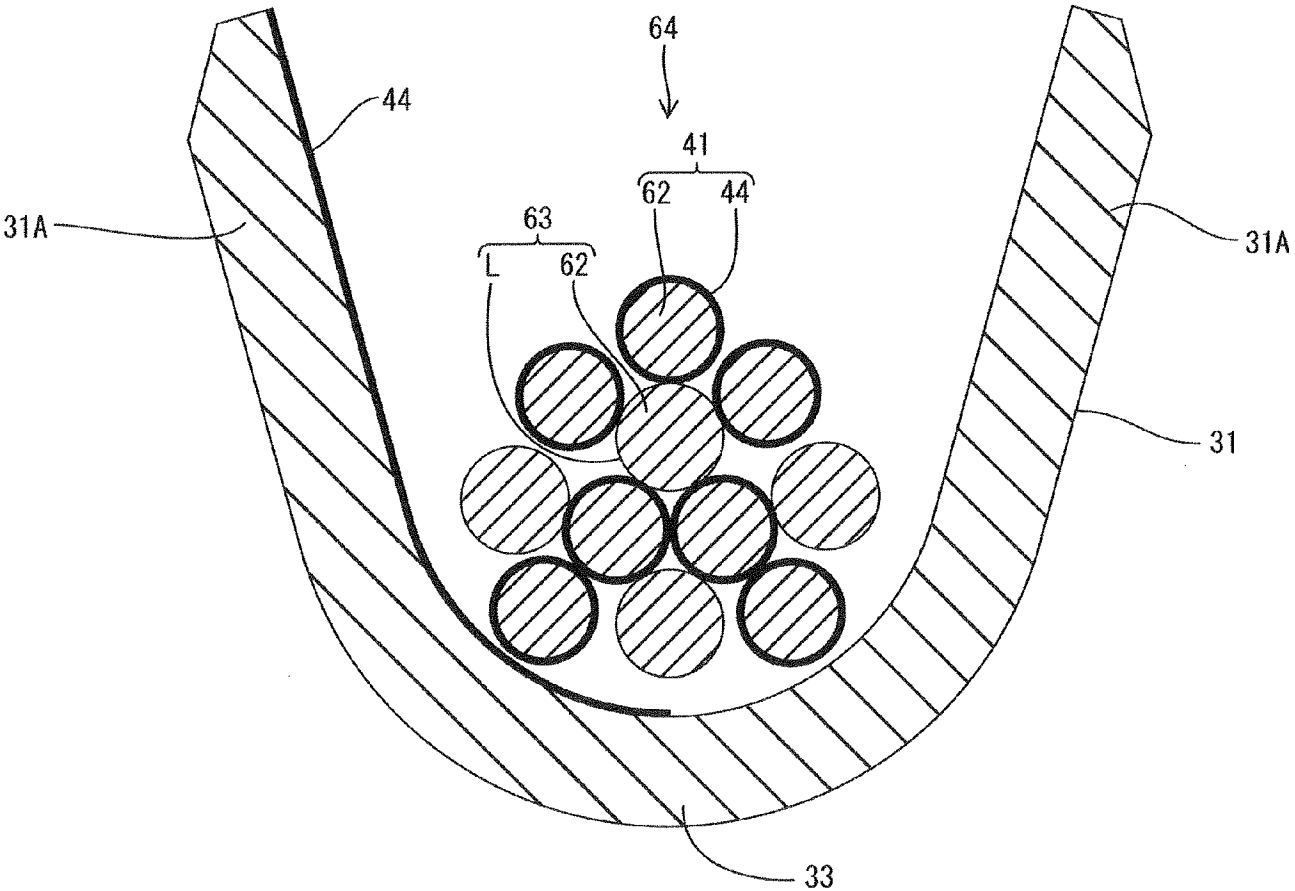
FIG. 11 is an enlarged cross-sectional view of a part of FIG. 8.
Figure 12:
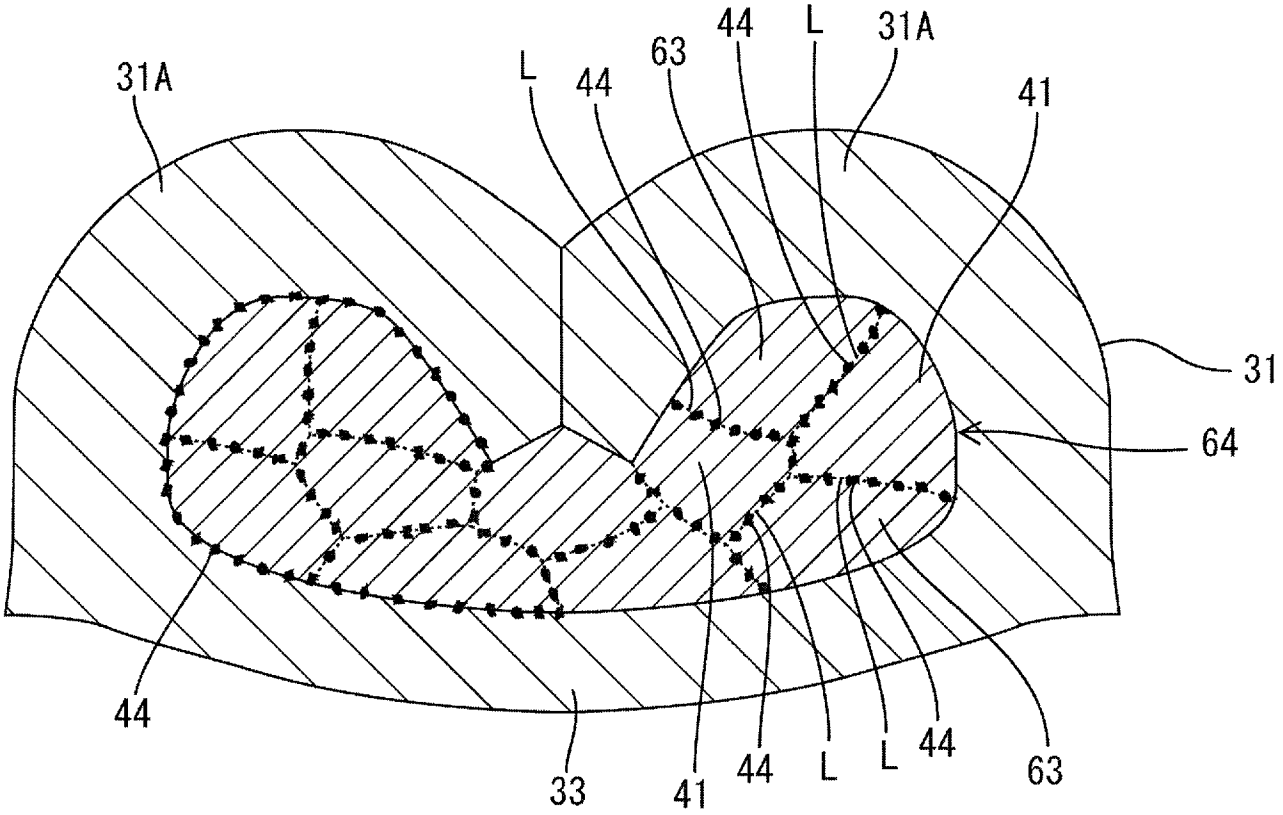
FIG. 12 is an enlarged cross-sectional view of a part of FIG. 10.

A brief explanation of how the alumite layer 44 breaks the oxide film L during the compression will be described with reference to FIG. 8 to FIG. 12. In FIG. 11 and FIG. 12, for brief explanation of how the alumite layer 44 breaks the oxide film L during the compression, a core wire 64 in which metal wires 63 and the metal wires 41 are mixed and bundled together is illustrated. The metal wires 63 each include a base material 62 that is made of aluminum alloy and has the oxide film L formed on its surface. The metal wires 41 each include the base material 62 that is made of aluminum alloy and has the alumite layer 44 formed on its surface. The wire barrel 31 that has the alumite layer 44 on the left half of the crimping surface and no alumite layer 44 on the right half is illustrated as an example.

Figure 8:
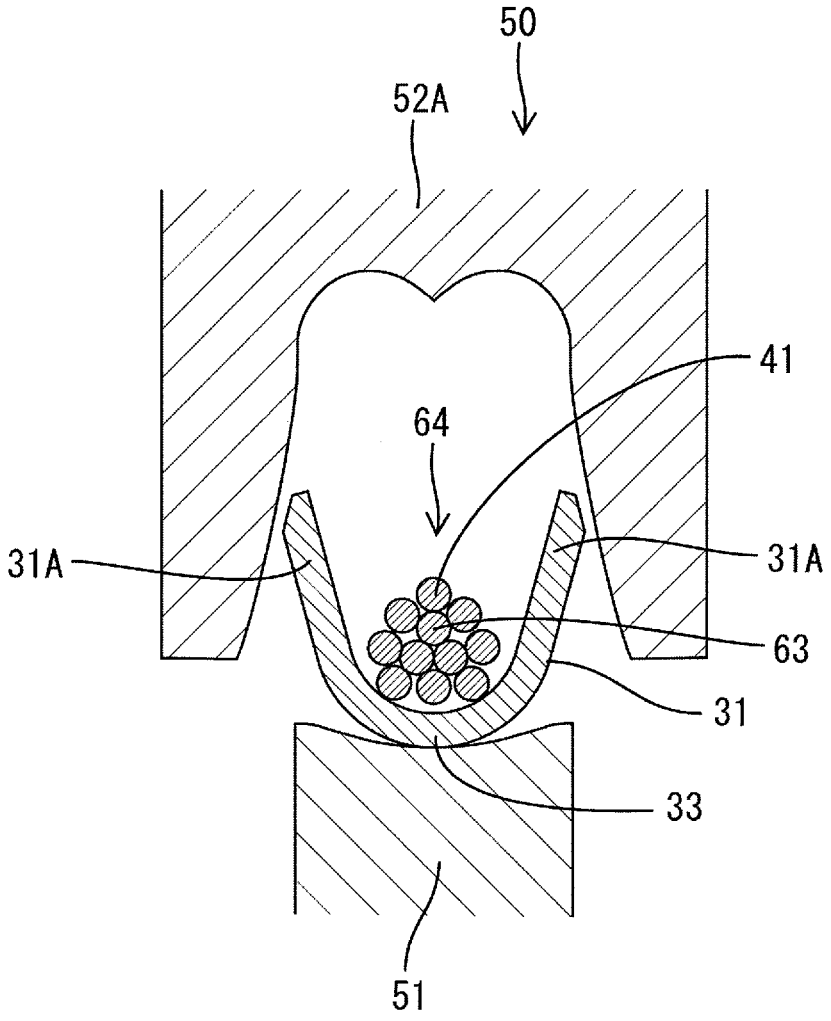
FIG. 8 is a front cross-sectional view illustrating a state immediately before the crimp portion of the aluminum terminal is crimped by the crimper.

As illustrated in FIG. 8, the wire barrel 31 and the core wire 64 are arranged on the anvil 51. In this state, the first crimper 52A is moved down, and thus the swaging pieces 31A, 31A are bent inwardly by the first crimper 52A, and then the swaging pieces 31A, 31A are buried among the core wire 64 from the upper side as illustrated in FIG. 9. The first crimper 52A is further moved down, and thus, as illustrated in FIG. 10, the wire barrel 31 is crimped to the core wire 64 with the metal wires 41, 63 deformed.

At this time, the alumite layer 44 is broken because the alumite layer 44 cannot be deformed along with the deformation of the metal wires 41 and the swage pieces 31A, 31A. As illustrated in FIG. 12, the broken alumite layer 44 breaks the oxide film L by scratching and peeling the oxide film L on the surface of each metal wire 63, and thus the core of each metal wire 41 covered by the alumite layer 44 is uncovered. Then, the aluminum alloy that is the core of the metal wire 41 and the aluminum alloy that is the core of the metal wire 63 are pressure contacted with each other and integrated, and thus they are electrically conductively connected. In this configuration, the oxide film L that does not come in contact with the serration 34 and the alumite layer 44 can be broken, and thus the metal wires 41, 63 at the inner side of the core wire 64 are electrically conductively connected. With this configuration, the stable electrical connection resistance can be obtained by the wire barrel 31 that is lowly compressed, i.e., the wire barrel 31 is not required to be highly compressed.

EXAMPLE

Hereinafter, the embodiment will be described in more detail with reference to an example. In the following description, an aluminum terminal corresponds to the electric wire with the terminal connector 10 of the embodiment and an aluminum electric wire corresponds to the core wire 42 of the covered electric wire 40.

Figure 13:
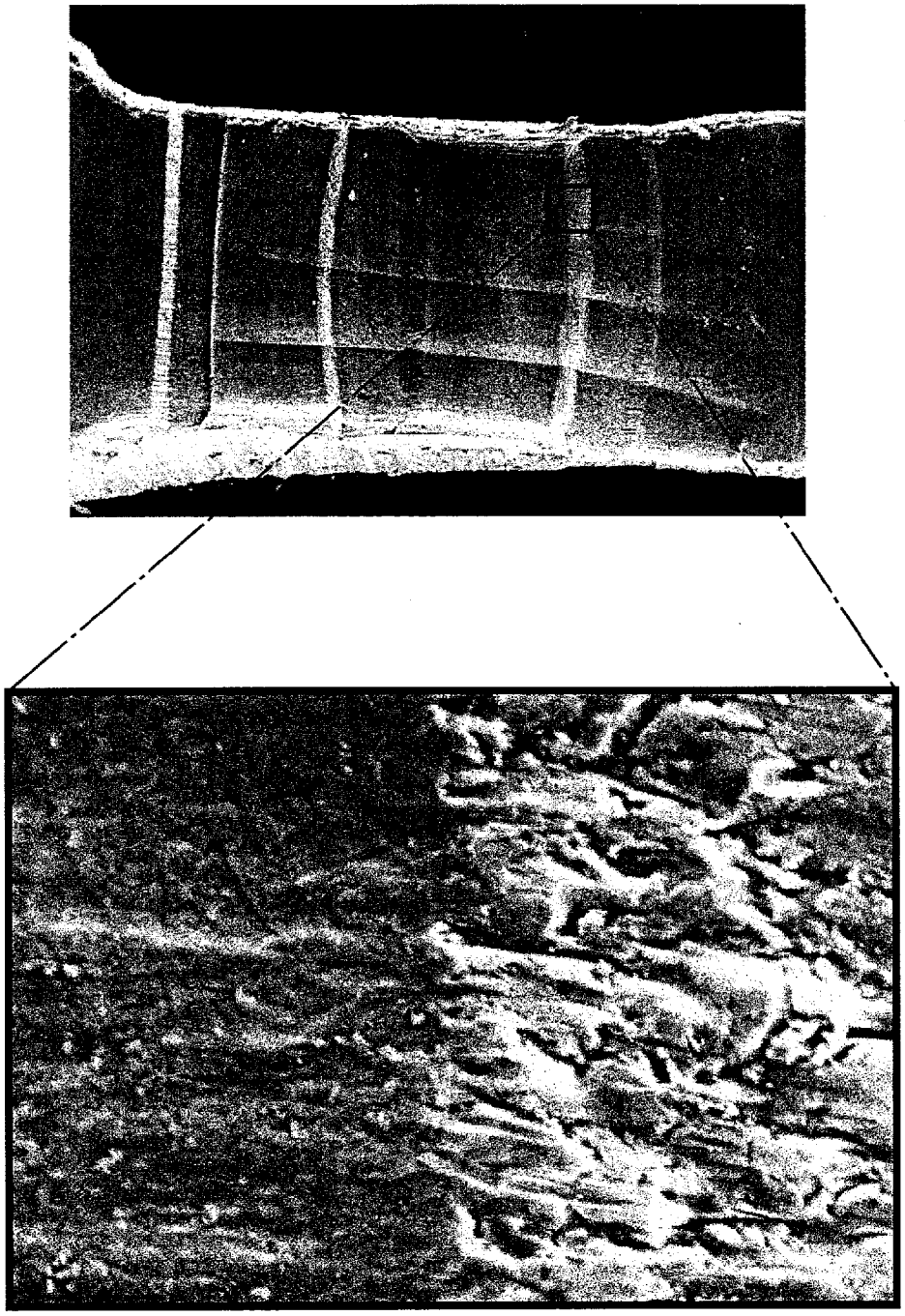
FIG. 13 is an SEM image of a non-alumite-treated crimped surface of a wire barrel.
Figure 14:
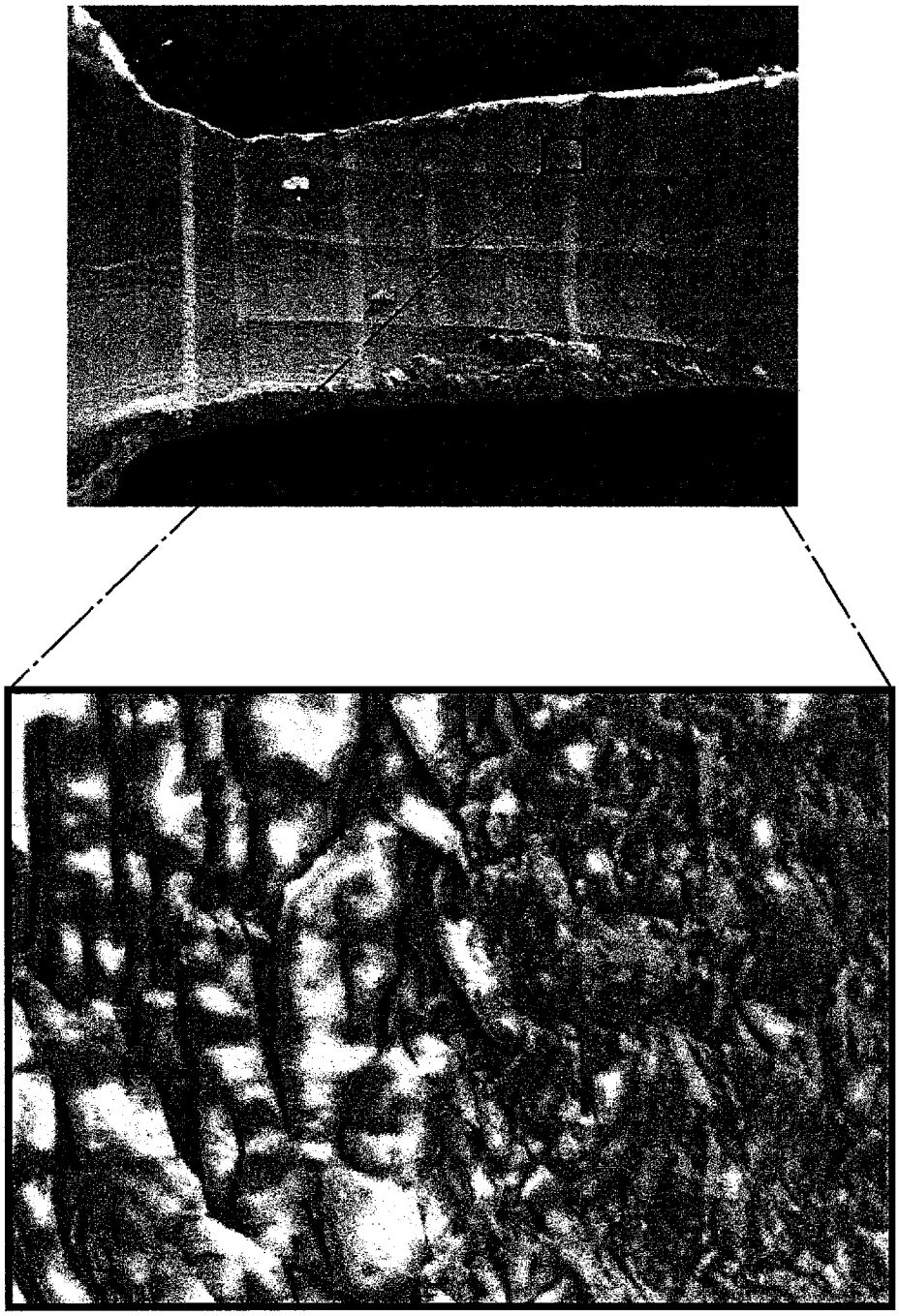
FIG. 14 is an SEM image of an alumite treated crimped surface of a wire barrel.
Figure 15:
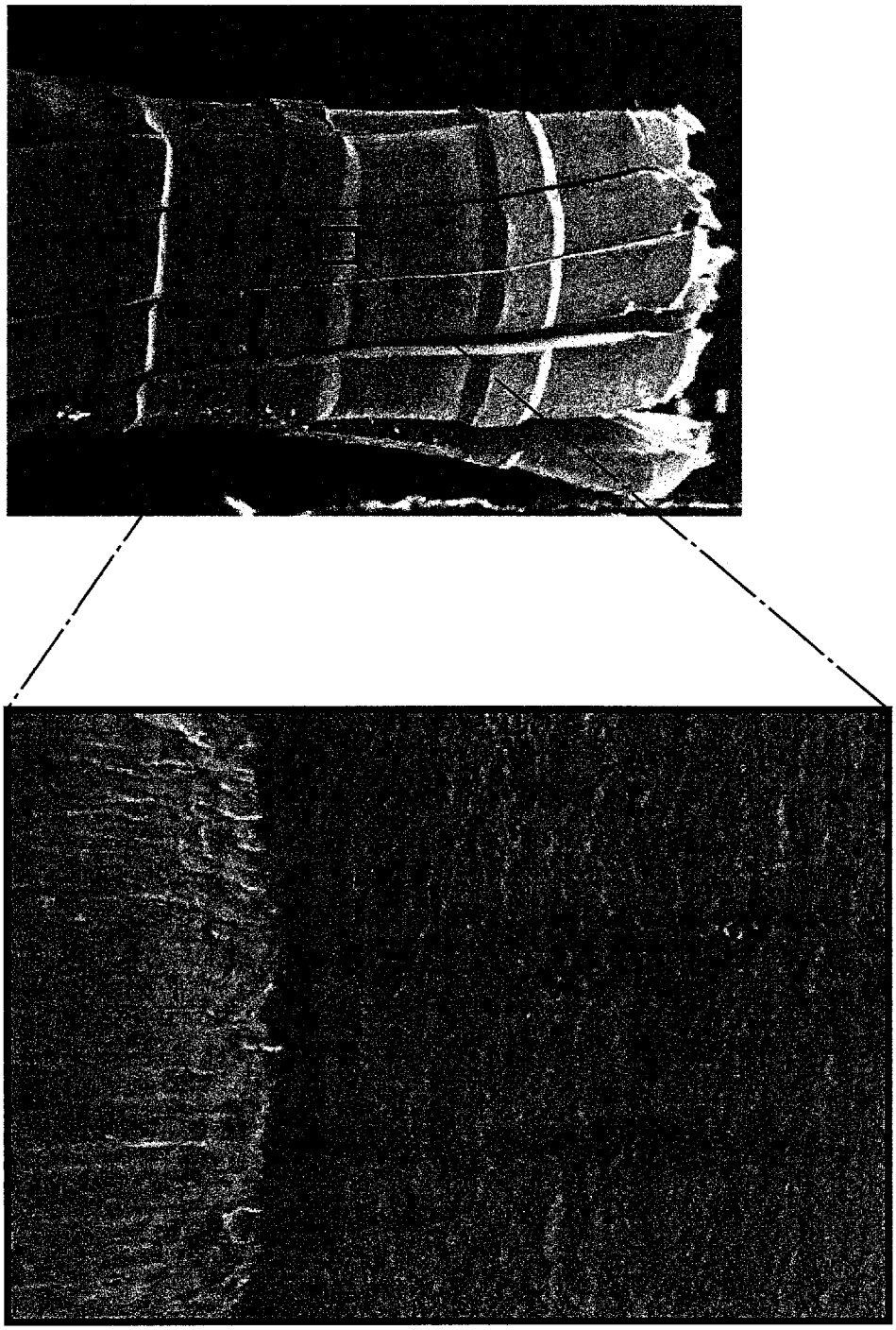
FIG. 15 is an SEM image of a crimped surface of a core wire and corresponds to FIG. 13.

A condition of a surface that was subjected to an alumite treatment and a surface that was not subjected to the alumite treatment will be described with reference to FIG. 13 to FIG. 16. A non-alumite-treated aluminum terminal was crimped to a non-alumite-treated aluminum electric wire, and then the aluminum electric wire was separated away from the aluminum terminal. FIG. 13 is an SEM image of a crimping surface of the aluminum terminal. FIG. 15 is an SEM image of a crimped surface of the aluminum electric wire. As illustrated in a left part of an enlarged view of FIG. 13, the crimping surface of the aluminum terminal is smooth. As illustrated in a right part of an enlarged view of FIG. 15, the crimped surface of the aluminum terminal is smooth.

Figure 16:
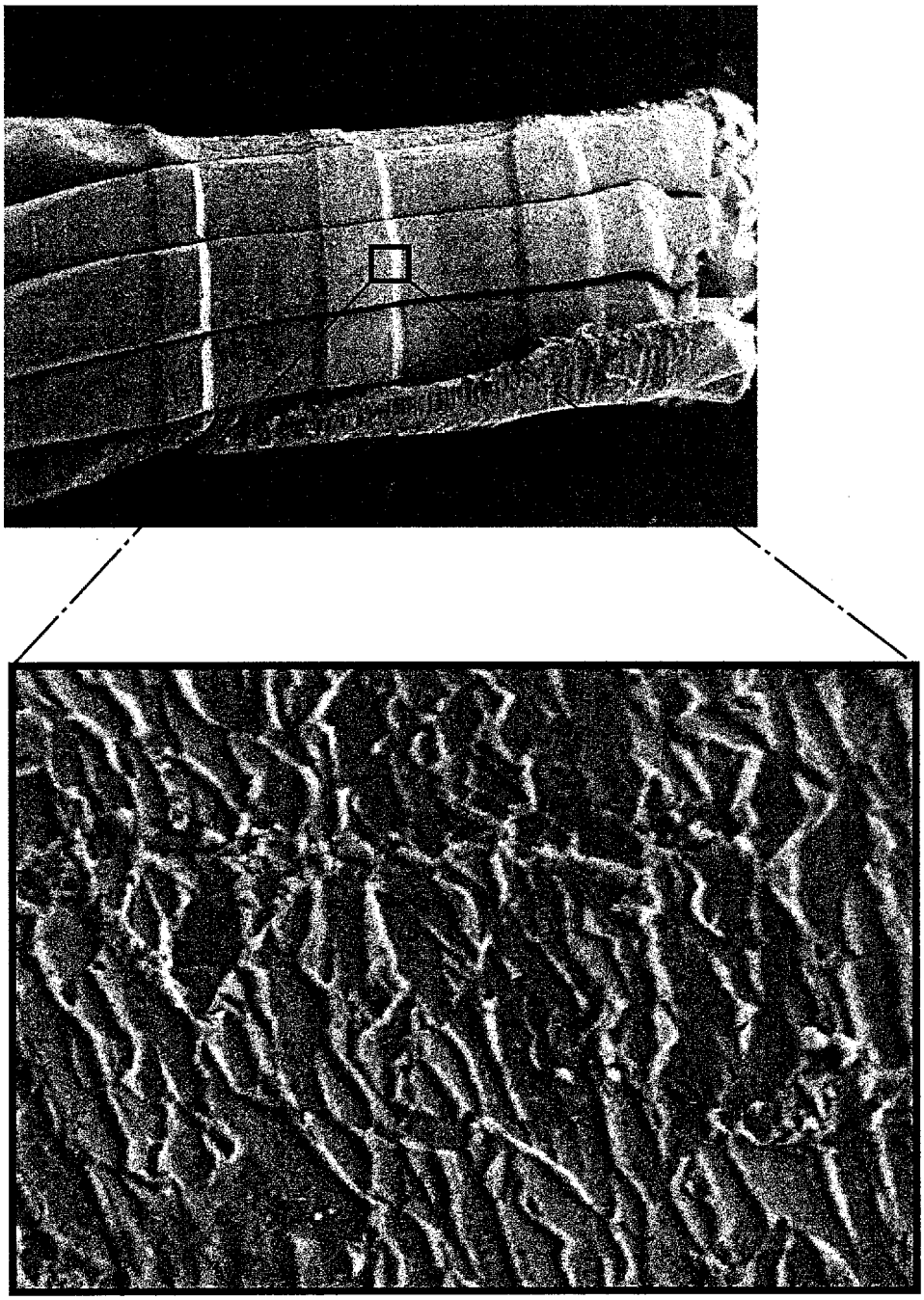
FIG. 16 is an SEM image of a crimped surface of a core wire and corresponds to FIG. 13.

Next, an alumite treated aluminum terminal was crimped to a non-alumite-treated aluminum electric wire, and then the aluminum electric wire was separated away from the aluminum terminal. FIG. 14 is an SEM image of a crimping surface of the aluminum terminal. FIG. 16 is an SEM image of a crimped surface of the aluminum electric wire. As illustrated in a left part of an enlarged view of FIG. 14, scaly alumite treated pieces were formed by breaking the alumite layer on the crimping surface of the aluminum terminal. The crimping surface has small bumps and dents as a whole. Similarly, as illustrated in FIG. 16, the crimped surface of the aluminum electric wire has transferred small bumps and dents.

As is clear from the SEM images, the scaly alumite treated pieces break the oxide film of the aluminum electric wire, and thus the oxide film can be broken by not only the edges of the serration, but also by the entire of the crimping surface of the aluminum terminal. To break the oxide film by this method, the alumite should be broken into the scaly alumite pieces in advance. The crimped surface of the aluminum electric wire is required to be deformed to break the alumite before the crimping surface of the aluminum terminal is crimped to the crimped surface of the aluminum electric wire.

Figure 17:
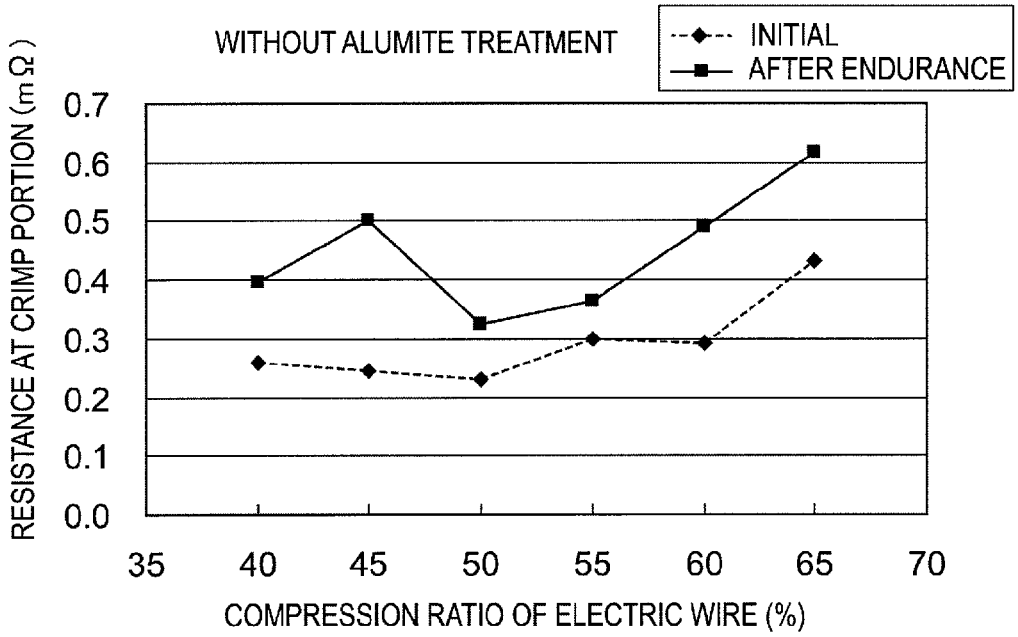
FIG. 17 is a graph of data (non-alumite-treated crimped surface) in Table 1.
Figure 18:
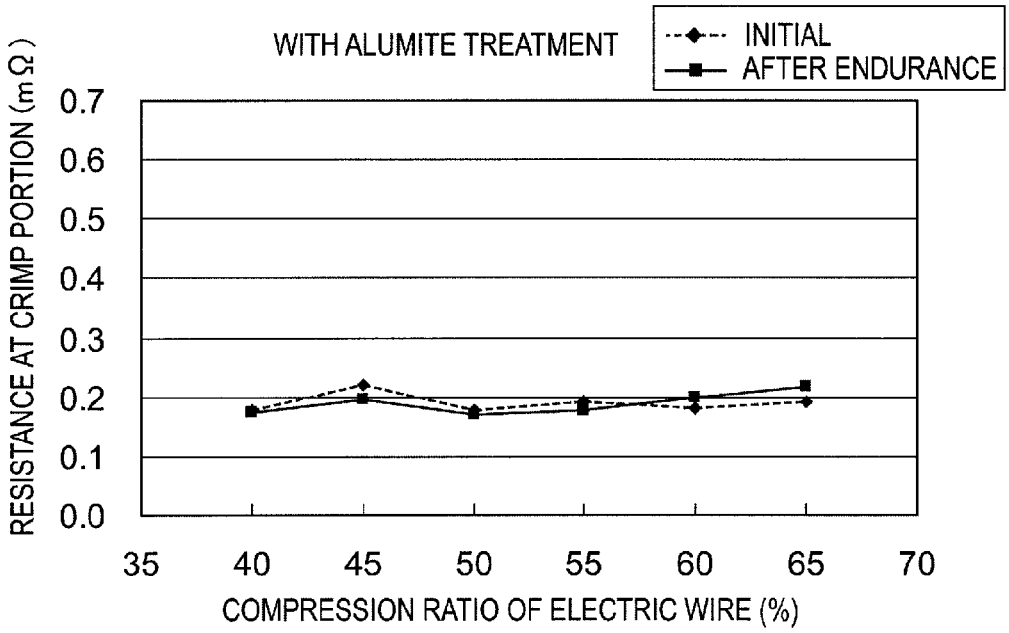
FIG. 18 is a graph of data (alumite treated crimped surface) in Table 2.

Next, changes in resistance at the crimp portion that were subjected to an endurance testing (thermal shock testing) will be described with reference to FIG. 17 and FIG. 18. A base material of the aluminum terminal that was used in the endurance testing was obtained by T6 treating (heating at 550° C. for three hours, cooling with water, and then heating at 175° C. for 16 hours) an aluminum alloy plate that is composed of 6000 series alloy (for example, 6061 alloy) of JIS (JIS H 4000:1999). The alumite layers that were used in the endurance testing have a mean thickness of 2 μm. The mean thickness was determined based on the SEM images of cross sections of the wire barrels. FIG. 17 illustrates changes in resistance at a crimp portion of an aluminum electric wire with an aluminum terminal that includes a non-alumite-treated aluminum electric wire and a non-alumite-treated aluminum terminal that was crimped to the non-alumite-treated aluminum electric wire. FIG. 18 illustrates changes in resistance at a crimp portion of an aluminum electric wire with an aluminum terminal that includes a non-alumite-treated aluminum electric wire and an alumite treated aluminum terminal that was crimped to the non-alumite-treated aluminum electric wire. The term "resistance at the crimp portion" is used synonymously with the term "electrical connection resistance" in the embodiment.

Table 1 below is original data for the graph of FIG. 17. Table 2 is original data for the graph of FIG. 18. The compression ratio in FIG. 17 and FIG. 18 is a ratio calculated by dividing a cross-sectional area of a core wire before crimping by a cross-sectional area of the core wire after the crimping. The wire barrel is more tightly crimped as the compression ratio decreases. The wire barrel is more loosely crimped as the compression ratio increases.

TABLE 1

| WITHOUT ALUMITE TREATMENT | | | | | | |
|---|---|---|---|---|---|---|
| | COMPRESSION RATIO (%) | | | | | |
| | 40 | 45 | 50 | 55 | 60 | 65 |
| INITIAL RESISTANCE AT CRIMP PORTION (mΩ) | | | | | | |
| ave (mΩ) | 0.26 | 0.25 | 0.23 | 0.30 | 0.29 | 0.43 |
| max (mΩ) | 0.43 | 0.41 | 0.32 | 0.35 | 0.50 | 0.47 |
| min (mΩ) | 0.15 | 0.15 | 0.17 | 0.23 | 0.19 | 0.40 |
| RESISTANCE AT CRIMP PORTION AFTER ENDURANCE (mΩ) | | | | | | |
| ave (mΩ) | 0.40 | 0.50 | 0.32 | 0.36 | 0.49 | 0.62 |
| max (mΩ) | 0.66 | 0.75 | 0.51 | 0.60 | 0.91 | 0.74 |
| min (mΩ) | 0.23 | 0.31 | 0.24 | 0.16 | 0.27 | 0.50 |

TABLE 2

| WITH ALUMITE TREATMENT | | | | | | |
|---|---|---|---|---|---|---|
| | COMPRESSION RATIO (%) | | | | | |
| | 40 | 45 | 50 | 55 | 60 | 65 |
| INITIAL RESISTANCE AT CRIMP PORTION (mΩ) | | | | | | |
| ave (mΩ) | 0.18 | 0.22 | 0.18 | 0.19 | 0.18 | 0.19 |
| max (mΩ) | 0.20 | 0.29 | 0.20 | 0.21 | 0.20 | 0.22 |
| min (mΩ) | 0.15 | 0.14 | 0.16 | 0.18 | 0.15 | 0.17 |
| RESISTANCE AT CRIMP PORTION AFTER ENDURANCE (mΩ) | | | | | | |
| ave (mΩ) | 0.18 | 0.20 | 0.17 | 0.18 | 0.20 | 0.22 |
| max (mΩ) | 0.26 | 0.25 | 0.23 | 0.20 | 0.33 | 0.26 |
| min (mΩ) | 0.08 | 0.15 | 0.12 | 0.16 | 0.12 | 0.18 |

As illustrated in FIG. 18, the aluminum electric wire with the alumite treated aluminum terminal has lower resistance at the crimp portion as a whole than the aluminum electric wire with the non-alumite-treated aluminum terminal. Further, the aluminum electric wire with the alumite treated aluminum terminal has low resistance at the crimp portion regardless of the compression ratio. In FIG. 18, the resistance at the crimp portion is stable at 0.2 mΩ in a range of the compression ratio of 40 to 65% before and after the endurance testing. The resistance at the crimp portion show little increase, which indicates that the stable resistance at the crimp portion is obtained. On the other hand, as illustrated in FIG. 17, in the aluminum electric wire with the non-alumite-treated aluminum terminal, the resistance at the crimp portion increases by a maximum of 0.2 mΩ in a range of the compression ratio of 40 to 65% after the endurance testing. In the aluminum electric wire with the alumite treated aluminum terminal, the resistance at the crimp portion before and after the endurance testing show little change and the low resistance are maintained. Particularly, the resistance at the crimp portion did not increase at the compression ratio of 65% that is regarded as the mildest compression condition, which means that the resistance at the crimp portion is stable even under the mild compression condition. Accordingly, the aluminum electric wire with the alumite treated aluminum terminal can maintain low resistance for a long period of time.

Figure 19:
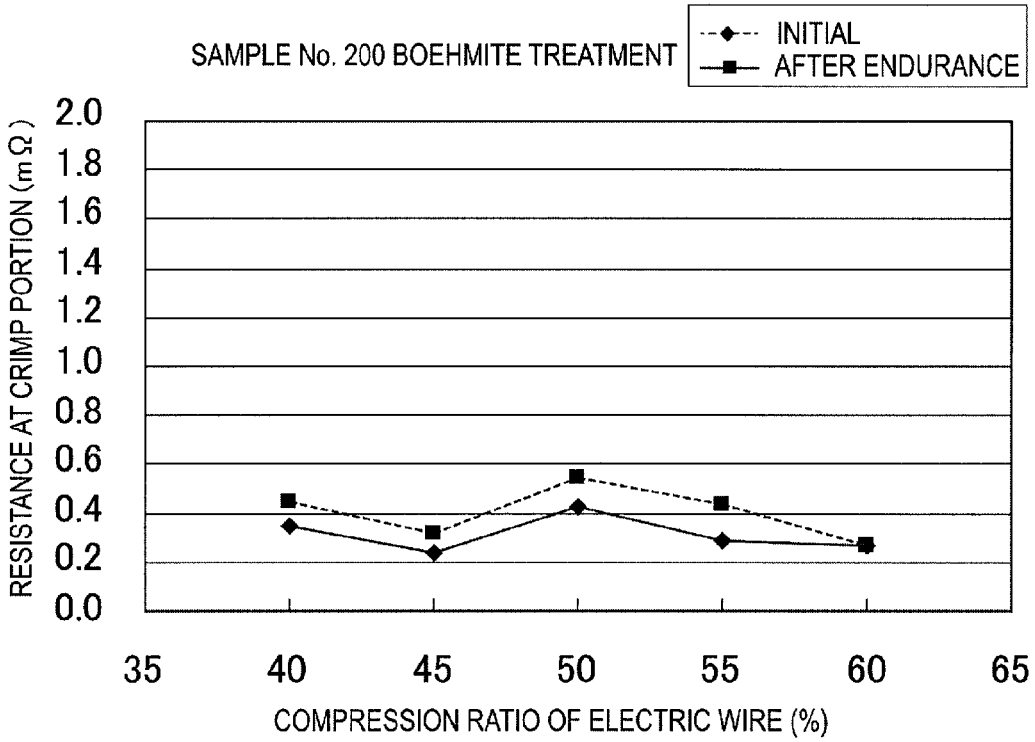
FIG. 19 is a graph of data (boehmite treated Sample No. 200) in Table 3.
Figure 20:
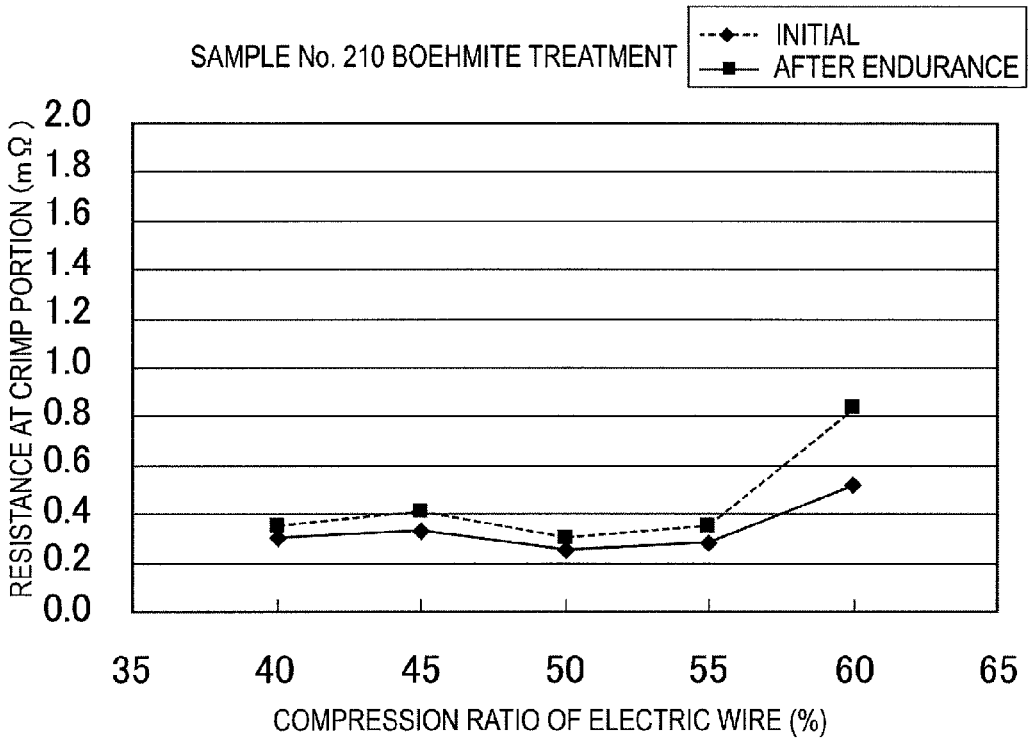
FIG. 20 is a graph of data (boehmite treated Sample No. 210) in Table 4.
Figure 21:
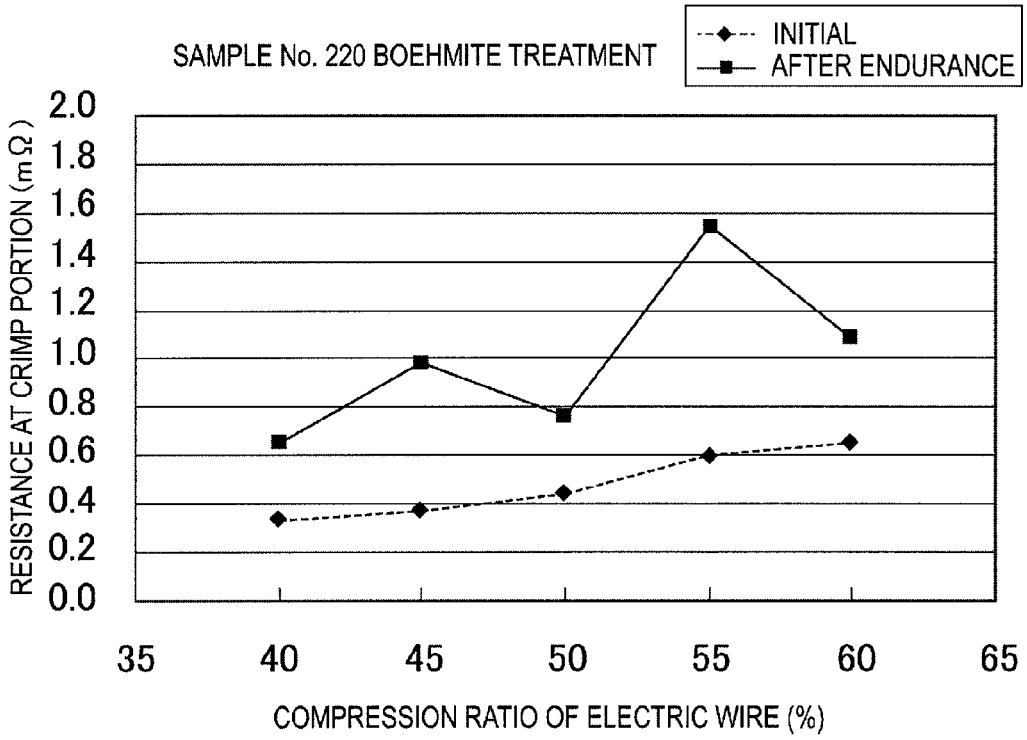
FIG. 21 is a graph of data (boehmite treated Sample No. 220) in Table 5.

Next, with reference to FIG. 19 and FIG. 21, changes in resistance after an endurance testing (thermal shock testing) at a crimp portion including a wire barrel that was subjected to the boehmite treatment, instead of the alumite treatment, will be described. Table 3 below is original data for the graph in FIG. 19, Table 4 is original data for the graph in FIG. 20, and Table 5 is original data for graphs in FIG. 21. The compression ratio in FIG. 19 to FIG. 21, which is synonymous with the compression ratio in FIG. 17 and FIG. 18, is a ratio calculated by dividing a cross-sectional area of a core wire before crimping by a cross-sectional area of the core wire after the crimping. The wire barrel 31 is more tightly crimped as the compression ratio decreases. The wire barrel 31 is more loosely crimped as the compression ratio increases.

TABLE 3

| SAMPLE No. 200 BOEHMITE TREATMENT | | | | | |
|---|---|---|---|---|---|
| | COMPRESSION RATIO (%) | | | | |
| | 40 | 45 | 50 | 55 | 60 |
| INITIAL RESISTANCE AT CRIMP PORTION (mΩ) | | | | | |
| ave (mΩ) | 0.35 | 0.24 | 0.43 | 0.28 | 0.26 |
| max (mΩ) | 0.52 | 0.34 | 0.75 | 0.36 | 0.42 |
| min (mΩ) | 0.29 | 0.17 | 0.29 | 0.18 | 0.19 |

TABLE 3-continued

| SAMPLE No. 200 BOEHMITE TREATMENT | | | | | |
|---|---|---|---|---|---|
| | COMPRESSION RATIO (%) | | | | |
| | 40 | 45 | 50 | 55 | 60 |
| RESISTANCE AT CRIMP PORTION AFTER ENDURANCE (mΩ) | | | | | |
| ave (mΩ) | 0.45 | 0.31 | 0.55 | 0.43 | 0.27 |
| max (mΩ) | 0.80 | 0.40 | 0.86 | 0.63 | 0.41 |
| min (mΩ) | 0.28 | 0.27 | 0.32 | 0.32 | 0.16 |

TABLE 4

| SAMPLE No. 210 BOEHMITE TREATMENT | | | | | |
|---|---|---|---|---|---|
| | COMPRESSION RATIO (%) | | | | |
| | 40 | 45 | 50 | 55 | 60 |
| INITIAL RESISTANCE AT CRIMP PORTION (mΩ) | | | | | |
| ave (mΩ) | 0.30 | 0.33 | 0.25 | 0.29 | 0.52 |
| max (mΩ) | 0.38 | 0.53 | 0.28 | 0.37 | 0.67 |
| min (mΩ) | 0.22 | 0.27 | 0.23 | 0.18 | 0.22 |
| RESISTANCE AT CRIMP PORTION AFTER ENDURANCE (mΩ) | | | | | |
| ave (mΩ) | 0.35 | 0.41 | 0.30 | 0.35 | 0.83 |
| max (mΩ) | 0.53 | 0.73 | 0.35 | 0.50 | 1.28 |
| min (mΩ) | 0.22 | 0.18 | 0.24 | 0.23 | 0.34 |

TABLE 5

| SAMPLE No. 220 BOEHMITE TREATMENT | | | | | |
|---|---|---|---|---|---|
| | COMPRESSION RATIO (%) | | | | |
| | 40 | 45 | 50 | 55 | 60 |
| INITIAL RESISTANCE AT CRIMP PORTION (mΩ) | | | | | |
| ave (mΩ) | 0.33 | 0.38 | 0.45 | 0.60 | 0.65 |
| max (mΩ) | 0.52 | 0.47 | 0.57 | 0.85 | 0.78 |
| min (mΩ) | 0.24 | 0.26 | 0.40 | 0.40 | 0.39 |
| RESISTANCE AT CRIMP PORTION AFTER ENDURANCE (mΩ) | | | | | |
| ave (mΩ) | 0.65 | 0.98 | 0.76 | 1.55 | 1.08 |
| max (mΩ) | 1.36 | 3.11 | 0.98 | 3.89 | 1.65 |
| min (mΩ) | 0.22 | 0.39 | 0.63 | 0.75 | 0.37 |

Aluminum terminals of Samples No. 200, 210, and 220 each include a wire barrel having a crimping surface that was subjected to a boehmite treatment. A well-known boehmite treatment was employed as the boehmite treatment. In the boehmite treatment, immersion periods were varied to obtain boehmite layers having different thicknesses. The immersion period of Sample No. 200 was the shortest, the immersion period of Sample No. 210 is longer than that of Sample No. 200, and the immersion period of Sample No. 220 is longer than that of Sample No. 210. After the boehmite treatment, the mean thickness of the boehmite layers was determined and the mean thickness of Sample No. 220 was 0.7 μm and the mean thickness of Sample No. 200 was 0.1 μm. The mean thickness was determined based on the SEM image of the cross section like the alumite layer.

As a core wire of the aluminum electric wire, a stranded wire including a plurality of metal wires (in which 1.05% of iron and 0.15% of magnesium are contained, by mass %, and the balance is aluminum) that are stranded (herein, eleven wires having a diameter of 0.3 mm are stranded) was provided. The core wire was placed on the wire barrel of each Sample No. 200, 210, 220 and swaged, and thus the wire barrel was crimped to the core wire. For each Sample No. 200, 210, 220, five samples were provided and compressed at respective compression ratios of 40, 45, 50, 55, and 60%.

For each Sample No, 200, 210, 220, an initial resistance (before the endurance testing) at the crimp portion, and a resistance after the endurance testing were determined. The aluminum terminal and the aluminum electric wire were measured by a four-terminal method to determine the resistance at the crimp portion. The results are illustrated in FIG. 19 to FIG. 21. FIG. 19 illustrates changes in the resistance at the crimp portion of an aluminum electric wire with an aluminum terminal in which an aluminum terminal of Sample No. 200 was crimped to the non-alumite-treated aluminum electric wire. FIG. 20 illustrates changes in resistance at the crimp portion of an aluminum electric wire with an aluminum terminal in which an aluminum terminal of Sample No. 210 was crimped to the non-alumite-treated aluminum electric wire. FIG. 21 illustrates changes in resistance at the crimp portion of an aluminum electric wire with an aluminum terminal in which an aluminum terminal of Sample No. 220 was crimped to the non-alumite-treated aluminum electric wire.

Sample No. 200 that includes the thinnest boehmite layer among Samples No. 200, 210, and 220, which were subjected to the boehmite treatment, has the resistance at the crimp portion substantially the same as the non-treated sample (see FIG. 17). Samples No. 210 and 220 that includes the thicker boehmite layer than Sample No. 200 each have larger resistance at the crimp portion than the non-treated sample. The initial resistance and the resistance after the endurance at the crimp portion of Sample No. 220 are different from each other. The resistance at the crimp portion became larger after the endurance. That is, after the boehmite treatment, the resistance at the crimp portion tends to become larger with a passage of time. Accordingly, if the boehmite treatment is performed, the boehmite layer is not broken, and thus the boehmite layer as an insulator is provided between the aluminum terminal and the wire barrel. This is because that the boehmite layer includes 30% of a dense layer and 70% of a porous layer in a total thickness, and the oxide film L cannot be broken due to the presence of the porous layer. On the other hand, almost entire of the alumite layer is a dense layer, and thus the alumite layer is easily broken and the pieces of the broken alumite layer easily breaks the oxide film L.

As described above, in this embodiment, the alumite layer 44 is formed on the surface of the metal wire 41 by the alumite treatment. With this configuration, the alumite layer 44 is broken during the crimping, and thus the broken alumite layer 44 can break the oxide film L on the surface of another metal wire 41. In addition, since the aluminum alloys that are cores of the metal wires 41 can be electrically conductively connected to each other in an integrated state, the metal wires 41 that do not appear at the outer circumferential surface of the core wire 42 can be connected to each other at an inner side. Further, since the alumite layer 44 is formed on every metal wire 41, the metal wires 41 can be securely connected. Further, the core of the metal wire 41 is made of aluminum alloy, the alumite layer 35 can be formed by performing the electrolytic treatment to the core.

In addition, the alumite layer 35 is formed on the crimping surface of the crimp portion 30 by the alumite treatment. With this configuration, the alumite layer 35 is broken during the crimping, and thus the broken alumite layer 35 can break the oxide film L on the surface of the metal wire 41. In addition, the aluminum alloys that are cores of the metal wires 41 and the aluminum alloy that is the base material of the crimp portion 30 can be electrically conductively connected to each other in an integrated state. Further, since the base material of the crimp portion 30 is made of the aluminum alloy, the alumite layer 35 can be formed by performing the electrolytic treatment to the base material.

<Other Embodiments>

The present invention is not limited to the embodiment described in the above description and explained with reference to the drawings. The following embodiments may be included in the technical scope of the present invention.

(1) In the above embodiment, the aluminum alloy is used as the base material of the crimp portion. However, according to the present invention, aluminum may be used as the base material. In addition, copper alloy may be used as the base material and an aluminum alloy layer may be formed on a surface of the copper alloy. Then, the aluminum alloy layer may be subjected to an electrolytic treatment to form the alumite layer.

(2) In the above embodiment, the wire barrel 31 is an open barrel. However, according to the present invention, the wire barrel 31 may be a closed barrel.

(3) In the above embodiment, the hard layer is formed by performing the alumite treatment to the surface of an aluminum alloy layer. However, according to the present invention, the hard layer may be aluminum nitride, or the surface of the aluminum alloy layer may be subjected to Alodine treatment, which is also known as Alocrom treatment.

(4) In the above embodiment, the wire barrel 31 and the core wire 42 are subjected to the alumite treatment. However, according to the present invention, the wire barrel 31 alone may be subjected to the alumite treatment.

(5) In the above embodiment, the swaging pieces are swaged by the crimper such that the wire barrel 31 and the core wire 42 are swaged and connected. However, the present invention may be applied to an insulation-displacement connector in which a core wire is pressed between two blades such that the core wire and the blades are pressed against each other.

(6) According to this invention, the thickness of the alumite layer, the composition of the terminal connector, the composition of the covered electric wire, the configuration of the covered electric wire, and the diameter of the core wire of the covered electric wire, for example, may be properly changed.

The invention claimed is:

1. A terminal connector comprising:

a crimp portion to be crimped to an electric wire having an oxide film thereon, the crimp portion including:

a base material;

an aluminum layer or an aluminum alloy layer on a surface of the base material; and an alumite layer on a surface of the aluminum layer or the aluminum alloy layer, the alumite layer being a porous layer with a crystal structure denser than the oxide film and being harder than the base material, the alumite layer having a thickness of 1 μm or more and 10 μm or less.

2. The terminal connector according to claim 1, wherein the base material is a metal material that is same as a metal material constituting the aluminum layer or the aluminum alloy layer, the base material and the aluminum layer or the aluminum alloy layer being an integral member.

3. The terminal connector according to claim 2, wherein the base material is an aluminum alloy selected from 2000 series alloy, 6000 series alloy, and 7000 series alloy.

4. An electric wire with a terminal connector, comprising:

the terminal connector according to claim 2; and an electric wire including a core wire made of aluminum or aluminum alloy, wherein the crimp portion of the terminal connector being crimped to the core wire.

5. An electric wire with a terminal connector, comprising:

the terminal connector according to claim 3; and an electric wire including a core wire made of aluminum or aluminum alloy, wherein the crimp portion of the terminal connector is crimped to the core wire.

6. The terminal connector according to claim 1, wherein the base material is an aluminum alloy selected from 2000 series alloy, 6000 series alloy, and 7000 series alloy.

7. An electric wire with a terminal connector, comprising:

the terminal connector according to claim 1; and an electric wire including a core wire made of aluminum or aluminum alloy, wherein the crimp portion of the terminal connector being crimped to the core wire.

8. A method of connecting a terminal connector and an electric wire, the terminal connector including a crimp portion connected to the electric wire including a core wire made of aluminum or aluminum alloy having an oxide film thereon, the method comprising:

forming an alumite layer on a surface of an aluminum layer or an aluminum alloy layer formed on a surface of a base material included in the crimp portion, the alumite layer being a porous layer with a crystal structure denser than the oxide film and being harder than the base material, the alumite layer having a thickness of 1 μm or more and 10 μm or less; and deforming and crimping the crimp portion to the core wire such that the hard layer is broken, wherein the broken hard layer cuts a surface layer of the core wire such that a core of the core wire is uncovered, and the uncovered core and the base material are in pressure contact with each other.

9. The method of connecting a terminal connector and an electric wire according to claim 8, wherein the base material is a metal material that is same as a metal material constituting the aluminum layer or the aluminum alloy layer, the base material and the aluminum layer or the aluminum alloy layer being an integral member.

10. The method of connecting a terminal connector and an electric wire according to claim 9, wherein the base material is an aluminum alloy selected from 2000 series alloy, 6000 series alloy, and 7000 series alloy.

11. The method of connecting a terminal connector and an electric wire according to claim 8, wherein the base material is an aluminum alloy selected from 2000 series alloy, 6000 series alloy, and 7000 series alloy.

* * * * *